US012653288B2

(12) United States Patent
Au et al.

(10) Patent No.: US 12,653,288 B2
(45) Date of Patent: Jun. 16, 2026

(54) REMOVABLE TOTE COVER

(71) Applicant: Brooklyn Accessory Group LLC, Atlantic Beach, NY (US)

(72) Inventors: Alan Chunyi Au, Atlantic Beach, NY (US); Robert David Price, Brooklyn, NY (US)

(73) Assignee: Brooklyn Accessory Group LLC, Atlantic Beach, NY (US)

( * ) Notice: Subject to any disclaimer, the term of this patent is extended or adjusted under 35 U.S.C. 154(b) by 30 days.

(21) Appl. No.: 18/496,004

(22) Filed: Oct. 27, 2023

(65) Prior Publication Data

US 2024/0423339 A1 Dec. 26, 2024

Related U.S. Application Data

(60) Provisional application No. 63/510,046, filed on Jun. 23, 2023.

(51) Int. Cl.

| | |
|---|---|
| ***A45C 13/00*** | (2006.01) |
| ***A45C 3/06*** | (2006.01) |
| ***A45C 13/02*** | (2006.01) |

(52) U.S. Cl.

CPC ..... *A45C 13/002* (2013.01); *A45C 3/06* (2013.01); *A45C 13/02* (2013.01)

(58) Field of Classification Search

CPC ..... A45C 13/002; A45C 3/06; A45C 13/02

See application file for complete search history.

(56) References Cited

U.S. PATENT DOCUMENTS 2,432,365 A * 12/1947 Mannie ..... A45C 13/002 190/125
3,349,992 A * 10/1967 Skinner ..... A45C 13/002 383/81

(Continued)

FOREIGN PATENT DOCUMENTS

CA 2656657 A1 4/2010
CN 209846318 U 12/2019

(Continued)

OTHER PUBLICATIONS

Artscow, Custom Flap Closure Messenger Bag (L), accessed May 2, 2023, https://www.artscow.com/photo-gifts/bag/flap-closure-messenger-bag-1096.

(Continued)

*Primary Examiner* — Tri M Mai
(74) *Attorney, Agent, or Firm* — Thompson Patent Law Offices PC

(57) ABSTRACT

Apparatus and associated methods relate to a removable tote cover. In an illustrative example, the removable tote cover may include a detachable cover extending along a longitudinal axis. Some embodiments may advantageously be configured to cover an opening into an existing bag, the detachable cover having at least one handle aperture through each of opposing sides of the cover. In some embodiments, the handles may be configured such that at least one handle of the existing bag is received through the at least one handle while both ends of the handles remain coupled to the bag. In some embodiments, the detachable cover may, for example, include an aperture closure module configured to selectively provide access into the existing bag through the detachable cover. Some embodiments may, for example, be configured such that each of the at least one handle aperture extends to a peripheral edge of the detachable cover.

13 Claims, 21 Drawing Sheets

(56) References Cited

U.S. PATENT DOCUMENTS

| | | | | | |
|---|---|---|---|---|---|
| 4,907,633 | A | | 3/1990 | Eckstein | |
| 4,953,674 | A | * | 9/1990 | Landes | A45C 3/004 190/102 |
| 5,209,279 | A | | 5/1993 | Wilson | |
| 6,003,573 | A | | 12/1999 | Owens | |
| 6,231,233 | B1 | * | 5/2001 | Orce | B65D 33/004 383/106 |
| 6,318,528 | B1 | * | 11/2001 | Blanckaert | A45C 3/08 190/902 |
| D618,909 | S | | 7/2010 | Gaultier | |
| D656,313 | S | | 3/2012 | Dumas et al. | |
| 9,289,043 | B1 | | 3/2016 | Hantman | |
| D766,576 | S | * | 9/2016 | Hantman | D3/318 |
| D807,032 | S | | 1/2018 | Agazzi | |
| D848,145 | S | * | 5/2019 | Dumas | A45C 11/005 D3/232 |
| D917,162 | S | | 4/2021 | Dumas | |
| D971,595 | S | * | 12/2022 | Dumas | D3/232 |
| 2006/0144487 | A1 | | 7/2006 | Bockey | |
| 2007/0151895 | A1 | | 7/2007 | Patterson | |
| 2009/0065110 | A1 | | 3/2009 | Cassella | |
| 2013/0037186 | A1 | | 2/2013 | Randle | |

FOREIGN PATENT DOCUMENTS

| | | | | |
|---|---|---|---|---|
| CN | 216627711 | U | | 5/2022 |
| EM | 0019503870033 | | | 11/2011 |
| EM | 0032303580002 | | | 6/2016 |
| FR | 2846859 | A1 | | 5/2004 |
| JP | 07291309 | A | * | 11/1995 |
| JP | 2009178445 | A | * | 8/2009 |
| WO | 2021058871 | A1 | | 4/2021 |

OTHER PUBLICATIONS

Google Lens, Visual matches, accessed Jan. 9, 2023, https://lens.google.com/search?p=AXAp4wiTSe4xjVN1whn4_FAUBATN7g731uc8RMtDe7-IQ4j4QUTxE8cxN8cTCbZ5iIKQweZdAU6B_IVL_cfU2Y-mHiJV_B_AoEohXF8Q0KqO3jGXYYS2QICKZwfJHINh_iSctJR-5gGkrRq49kvYdardziNG_Cl2hUm6PVyiFPKfHoabaL3YK8H27YvNYZWbndpQGmr8Eb7TNcTwpNie2XWe_eMtaB-vQX5nfZjckJ8DWIPozkd1NQnN-g%3D%3D&ep=gisbubb&hl=en&re=df#Ins=W251bGwsbnVsbCxudWxsLG51bGwsbnVsbCxudWxsLG51bGwslkVrY0tKRGhqW.

Invitation Pursuant to Rules 66.2 et al.from the International Searching Authority in related International Application No. PCT/US2024/034631, dated May 12, 2025, 3 pages.

Response Under Rule 66 to the International Searching Authority in related International Application No. PCT/US2024/034631, dated Apr. 20, 2025, 10 pages.

Written Opinion of the International Searching Authority in related International Application No. PCT/US2024/034631, dated Mar. 27, 2025, 7 pages.

* cited by examiner

REMOVABLE TOTE COVER

CROSS-REFERENCE TO RELATED APPLICATIONS

This application also claims the benefit of U.S. Provisional Application Ser. No. 63/510,046, titled "Removable Tote Cover," filed by Brooklyn Accessory Group LLC, on Jun. 23, 2023.

TECHNICAL FIELD

Various embodiments relate generally to bags and bag accessories.

BACKGROUND

Tote bags are bags that include parallel handles that emerge from the side of its pouch. Tote bags are often used as reusable shopping bags. Tote bags recently have seen a great resurgence in use in the northeast region of the United States, because they are reusable bags and an alternative to plastic bags. Tote bags may, for example, be used until worn out and then be recycled. Northeastern states of the United States and European countries, such as the UK, have recently used tote bags more heavily as an eco-friendlier replacement to plastic bags. Some jurisdictions have mandated a phase out of plastic bags to reduce land and ocean pollution. Often these laws include a minimum price for a bag at check out and/or require a reusable tote bag or thick reusable plastic bag.

SUMMARY

Apparatus and associated methods relate to a removable tote cover. In an illustrative example, the removable tote cover may include a detachable cover extending along a longitudinal axis. Some embodiments may advantageously be configured to cover an opening into an existing bag, the detachable cover having at least one handle aperture through each of opposing sides of the cover. In some embodiments, the handles may be configured such that at least one handle of the existing bag is received through the at least one handle while both ends of the handles remain coupled to the bag. In some embodiments, the detachable cover may, for example, include an aperture closure module configured to selectively provide access into the existing bag through the detachable cover. Some embodiments may, for example, be configured such that each of the at least one handle aperture extends to a peripheral edge of the detachable cover.

Some embodiments may achieve one or more advantages. Each of the at least one handle apertures of some embodiments, may, for example, be advantageously configured with a width to span a distance between both ends of the handle when coupled to the bag. Each of the at least one handle aperture may, for example, include a plurality of interconnected apertures. The detachable cover may, for example, include a coupling module configured to releasably fasten the detachable cover to an existing tote bag. A detachable cover may, for example, extend along a longitudinal axis and have a continuous opening on opposing ends, such that the detachable cover may be placed over an existing handle attached to a bag at both ends of the handle without removing the handle, each end of the detachable cover having a coupling module configured to connect opposing edges of the corresponding end such that the detachable cover is coupled to the bag.

Some embodiments of the removable tote cover may, for example, be used across multiple different tote bags. The removable tote cover may, for example, be used across different types of bags (e.g., tote bags, purses, backpacks). The removable tote bag may, for example, be closed and connected in multiple ways by closure and connections coupling modules (e.g., zippers, magnets, locks, snaps/buttons, buckles, clips/carabineers, and cords/laces). The removable tote cover may, for example, provide additional functionality such as internal functionality (e.g., inside pockets, inside zipper pocket, phone holder, card holder, money holder) and external functionality (e.g., clips, name tag, pen holder, attachment places). The removable tote cover may, for example, be constructed out of two panels. The removable tote cover may, for example, be reversible. The removable tote cover may, for example, be located around tote bags in different ways (e.g., the placement of the handles inside the handle aperture, input of the handles into the handle aperture, output of the handles out of the handle apertures, the resting area handles within the handle apertures)

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary RTC is introduced in an illustrative use-case scenario with reference to FIG. 1. Second, FIG. 2 depicts a method of attachment of the RTC to an exemplary bag. Third, that introduction leads to a description with reference to FIGS. 3A-9B of some exemplary RTC embodiments. Fourth, FIGS. 10A-11 depict depictions of an exemplary RTC with some views that are described in application. Fifth, with reference to FIGS. 12-15D, the discussion turns to depictions of exemplary RTCs, different RTC coupling methods, and some exemplary RTC features.

Figure 1:
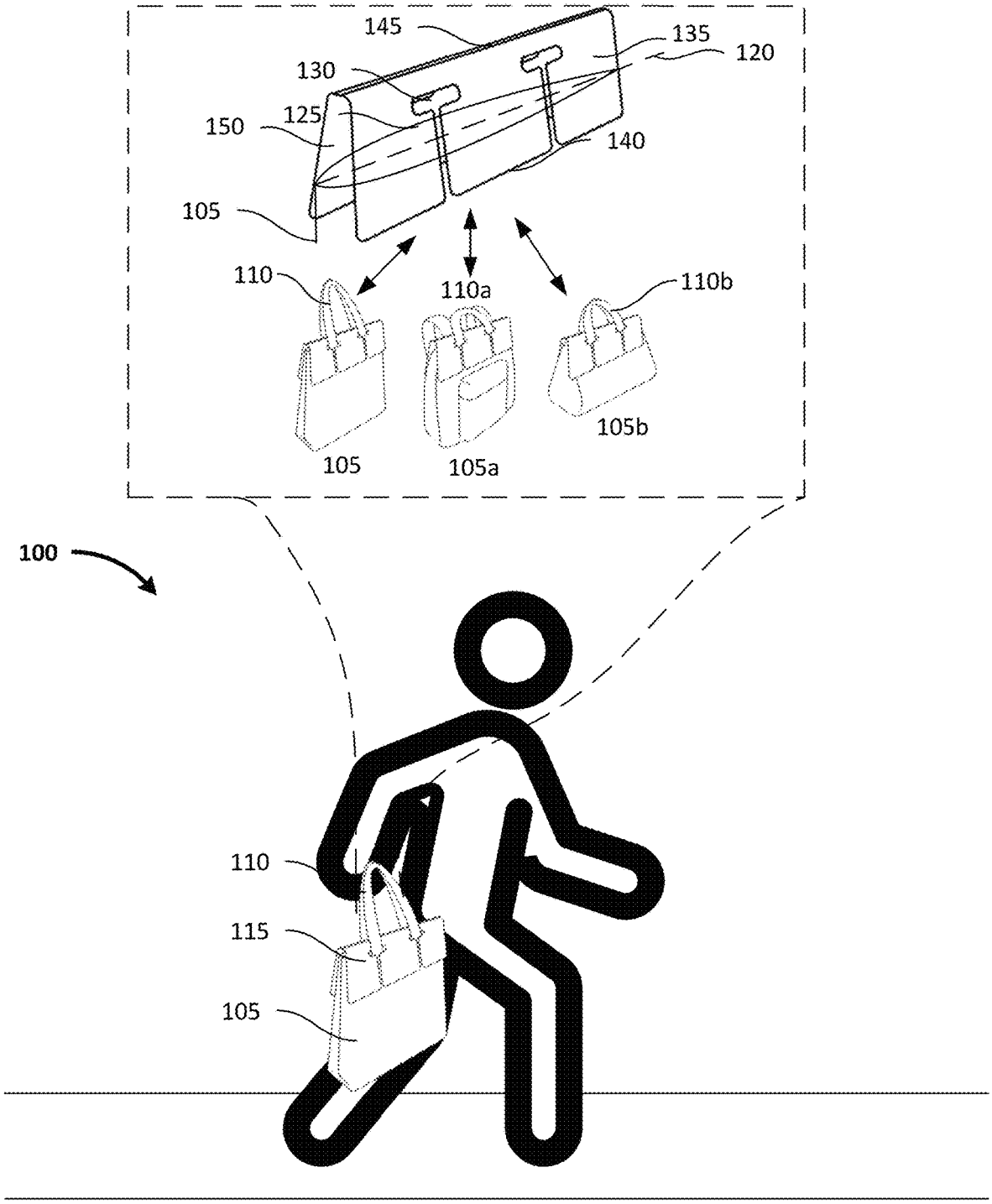
FIG. 1 depicts an exemplary removable tote cover (RTC) employed in an illustrative use-case scenario.
Figure 2:
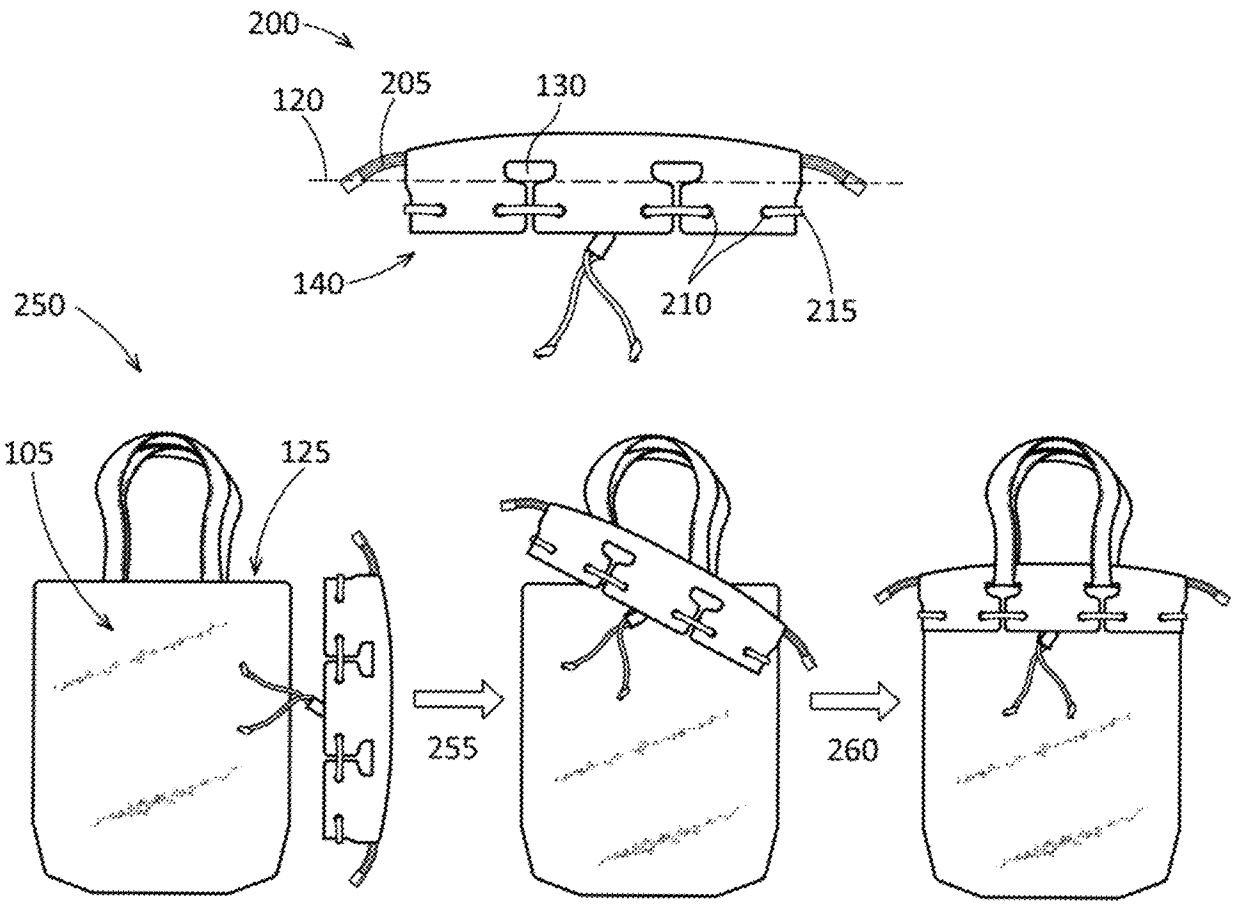
FIG. 2 depicts an exemplary RTC in an illustrative use-case scenario being used to cover a tote bag.

FIG. 1 depicts an exemplary removable tote cover (RTC) employed in an illustrative use-case scenario 100. The illustrative use-case scenario 100 includes an exemplary tote bag 105. The exemplary tote bag 105 includes exemplary handles 110. The exemplary handles 110 are threaded through two handle apertures of an exemplary RTC 115.

The exemplary RTC 115 includes a longitudinal axis 120. The tote bag 105 includes a bag's aperture 125. The exemplary RTC envelopes the bag's opening aperture 125. The exemplary RTC's longitudinal axis 120 extends along on the bag's opening aperture 125. The RTC's longitudinal axis may, for example, be centered along the bag's opening aperture. The removable tote cover 115 is coupled to the tote bag 105. The coupling may, for example, be caused because each handle thread is pulled by a user through the handle aperture of the exemplary RTC. The RTC may, for example, be configured to cover an opening of an existing bag.

The exemplary RTC 115 includes the first side of the cover 135. The first side of the cover may, for example, be referred to as the bottom portion of the cover. The exemplary RTC 115 includes a second opposing side 150 of the cover. The second opposing side of the cover may, for example, be referred to as the top portion of the cover. The top portion of the cover 150 and the bottom portion of the cover 135 may, for example, be folded along a middle portion of the cover 145 onto each other to form opposing sides.

The depicted RTC includes at least one handle aperture 130. The at least one handle aperture 130 extends through each of opposing sides of the cover. The at least one handle aperture 130, for example, extends through both the first side of the cover 135 and the second opposing side of the cover 150.

The handle apertures 130 are configured such that at least one handle of the existing bag is received through the at least one handle aperture while both ends of the handle remain coupled to the bag. The exemplary RTC 115 may include a lower peripheral edge 140. The handle apertures are configured such that the handle aperture opening begins at the peripheral edge. The handle aperture extends across the width of the exemplary RTC. The handle aperture extends past the opening of the bag, such that the handles may, for example, be passed through the handle apertures. The handle apertures includes a vertical channel aperture and a secondary aperture. The secondary apertures may, for example, include a horizontal aperture.

In an illustrative example, the first handle of a tote bag may, for example, be passed through the first vertical channels beginning at the periphery edge of the first cover of the exemplary RTC. The first handle may, for example, then be moved from the vertical channel of the handle aperture of the first cover to the secondary apertures of the first cover. Next, a second handle of the tote bag may, for example, be passed through the second vertical channel beginning at the periphery edge of the second opposing cover of the exemplary RTC. The second handle may, for example, then be moved from the vertical channel of the second opposing cover to the secondary apertures of the second opposing cover.

In some implementations, the detachable cover may, for example, have an aperture closure module configured to selectively provide access into the existing bag through the detachable cover.

In some implementations, each of the at least one handle apertures extend to a peripheral edge of the detachable cover.

In some implementations, each of the at least one handle apertures may, for example, be configured with a width to span a distance between both ends of the handle when coupled to the bag.

In some implementations, each of the at least one handle apertures include at least one of interconnected apertures.

In some implementations, the detachable cover may, for example, further include a coupling module configured to releasably fasten the detachable cover to the existing bag.

In some implementations, the detachable cover may, for example, extend along a longitudinal axis and have a continuous opening on opposing ends, such that the detachable cover may be placed over an existing handle attached to a bag at both ends of the handle without removing the handle, each end of the detachable cover having a coupling module configured to connect opposing edges of the corresponding end such that the detachable cover is coupled to the bag.

The RTC 115 may, for example, be coupled to the tote bag 105. The RTC may, for example, be releasably coupled. The RTC 115 may, for example, then be removed and coupled to a second tote bag 105*a*. The RTC may, for example, be then removed from tote bag 105*a* and then be coupled to a third tote bag 105*b*. In some implementations, the RTC may, for example, universally attach and decouple from a selection of tote bags with predetermined dimension ranges.

The exemplary RTC may, for example, include a kit including a range of tote bags alongside an exemplary RTC. The exemplary RTC may, for example, have adjustable dimensions such that length may, for example, extend to fit a bag. The exemplary RTC may, for example, have fixed dimensions.

FIG. 2 depicts an exemplary RTC 200. The RTC 200 includes a longitudinal axis 120 extending along its length. The exemplary RTC 200 includes a lower peripheral edge 140. The RTC 200 includes a middle portion configured with an opening module 205 that extends from the opposing sides of a top portion of the RTC and a bottom portion of the RTC. The opening module 205 includes a continuous opening on opposing ends, such that the detachable cover may be placed over an existing handle attached to a bag at both ends of the handle without removing the handle of the existing bag (as further depicted in FIG. 10 E, see continuous opening path segment 145*c*).

The middle portion between the top cover portion and the bottom cover portion may be configured to fold such that the top cover portion and the bottom cover portion overlay each other to form opposing sides. The middle portion may, for example, include an opening path extending along the longitudinal axis configured such that the middle portion may be engaged in an opening mode by operating a closure mechanism to decouple an opening path segment between a first portion of the middle path and a second portion of the middle path to form a middle portion opening aligned with the opening of the existing bag. The opening path may be closed with the closure mechanism by coupling the opening path segment of the first portion of the middle path together with the second portion of the middle path by operating the closure mechanism.

The RTC 200 includes closure apertures 210. The closure aperture may, for example, be lacing apertures. The closure apertures may, for example, be apertures intended for belts. The RTC includes a closure member 215. The closure member may, for example, include lacing. The closure member may, for example, include a belt. The RTC 200 includes handle apertures 130. The RTC 200 includes a closure module (e.g., a zipper, snaps, buttons, magnets, closing mechanism). The closure module may, for example, serve as an attachment mechanism (e.g., zipper, snaps, buttons, magnets). The bag 105 include a top aperture 125. The exemplary RTC 200 may, for example, be placed such that the longitudinal axis aligns with the top aperture, configured such that the tote bag's handles may be pulled through the handles apertures. The tote bag's handles may, for example, be pulled through the handle aperture beginning at the RTC's peripheral edge. The handles may, for example, be pulled through the vertical channel of the handle aperture to the top of the handle aperture. Lacing may, for example, then be threaded through the closure apertures and closed via a closure member. The handles may, for example, then be circumscribed by the handle aperture and the lacing. The lacing may, for example, include leather, threading, nylon, polymers, and threaded material.

FIG. 2 depicts an exemplary method 250 of coupling an exemplary RTC 200 to an exemplary tote bag 105. The exemplary method 250, begins with identifying a preexisting bag with a top aperture. Next, the user in step 255 the user threads the handles through the handle apertures. Finally, in step 260 the user secures the exemplary RTC to the bag.

Figure 3A:
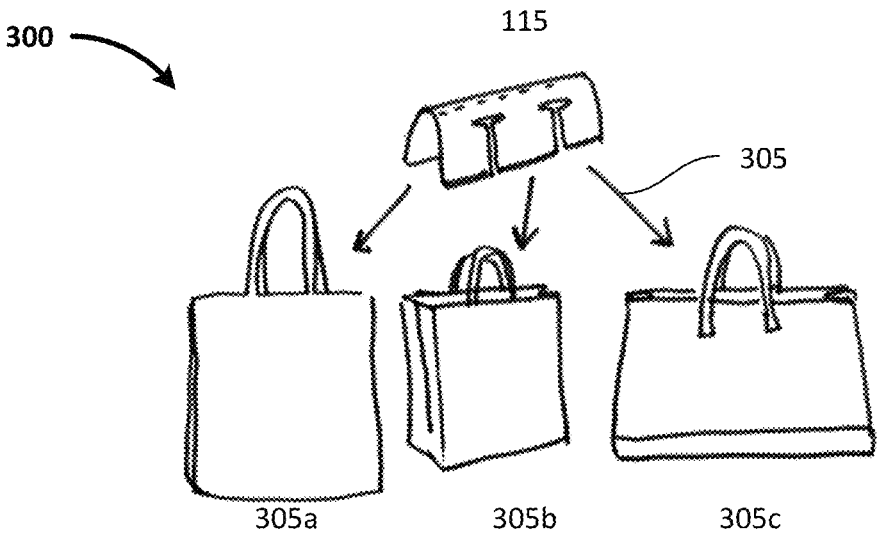
FIG. 3A depicts an exemplary RTC in an illustrative use-case scenario fitting multiple exemplary bags having different shapes, configurations, and sizes.

FIG. 3A depicts an exemplary RTC in an illustrative use-case scenario 300 fitting multiple exemplary bags having different shapes, configurations, and sizes. In the illustrative use-case scenario an exemplary RTC 115. The exemplary RTC 115 is releasably coupled 305 to exemplary bags having different shapes, configurations, and sizes. The exemplary RTC may, for example, be used across multiple bags. The exemplary RTC may, for example, releasably coupled to an exemplary bag 305 *a*. The exemplary RTC may, for example, be releasably coupled to an exemplary bag 305*b*. The exemplary RTC may, for example, be releasably coupled to an exemplary bag 305*c*.

Figure 3B:
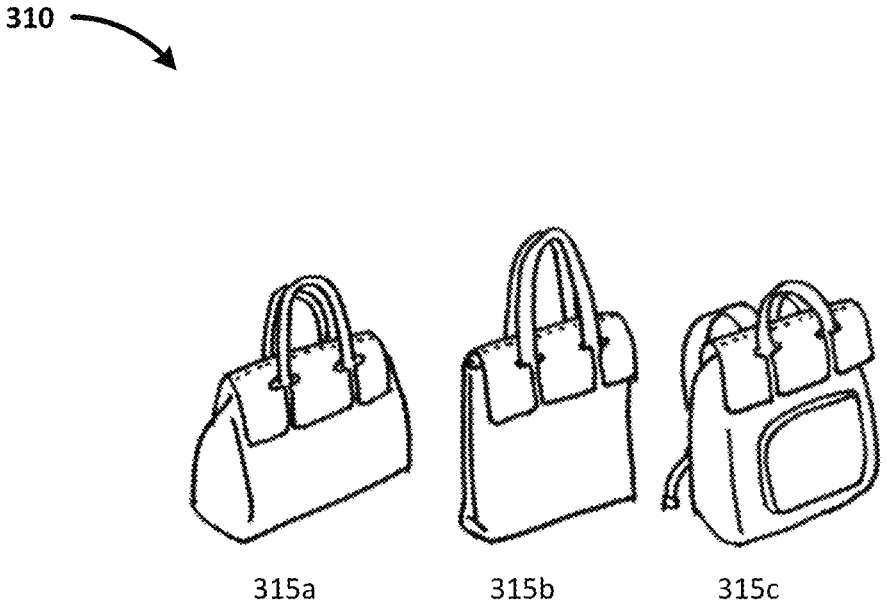
FIG. 3B depicts an exemplary RTC in an illustrative use-case scenario fitting different types of bags.

FIG. 3B depicts an exemplary RTC in an illustrative use-case scenario 310 fitting different types of bags. The exemplary RTC may, for example, be used across multiple bag types (e.g., backpacks; tote bags; purses; briefcases). The illustrative use-case scenario 310 includes a depiction of an exemplary RTC being coupled to a purse 315*a*. The illustrative use-case scenario includes a depiction of an exemplary RTC being coupled to a tote bag 315*b*. The illustrative use-case scenario includes a depiction of an exemplary RTC being coupled to an open style backpack 315*c*.

Figure 3C:
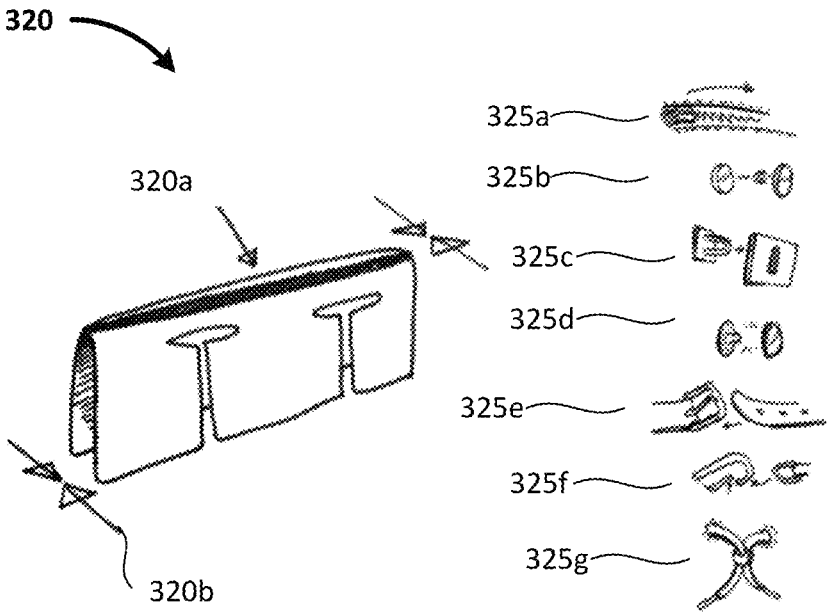
FIG. 3C depicts an exemplary RTC in an illustrative use-case scenario being closed and connected in multiple ways.

FIG. 3C depicts an exemplary RTC in an illustrative use-case scenario 320 being closed and connected in multiple ways. The illustrative use-case scenario 320 includes a depiction of the exemplary RTC being closed 320. The illustrative use-case scenario 320 includes a depiction of the exemplary RTC being connected. The closure and/or connection operation may, for example, be facilitated by zippers 325*a*. The closure and/or connection operation may, for example, be facilitated by magnets 325*b*. The closure and/or connection operation may, for example, be facilitated by locks 325*c*. The closure and/or connection operation may, for example, be facilitated by snaps and buttons 325*d*. The closure and/or connection operation may, for example, be facilitated by buckles 325*e*. The closure and/or connection operation may, for example, be facilitated by clips and/or carabiners 325*f*. The closure and/or connection operation may, for example, be facilitated by cords and/or laces 325*g*.

In some implementations, the closure mechanisms and connection mechanisms may, for example, include at least one closure mechanism. In some implementations, the closure mechanisms and connection mechanisms may, for example, include at least one connection mechanism.

In some implementations, the closure and connection mechanism may, for example, include two or more attachments mechanisms. In some implementations, the closure and connection function may, for example, include no attachment mechanism in addition to the handle apertures to couple the bag to the RTC. Including an attachment mechanism may, for example, create more secure coupling between the bag and RTC. Not including additional attachment mechanism aside from the handle apertures may, for example, offer a more ready to use and/or seamless coupling process between the bag and exemplary RTC. Two or more attachment mechanisms may offer a secure cover that may, for example, be more suitable for long travel trips in public commute locations such as trains, planes, and automotive travel.

Figure 3D:
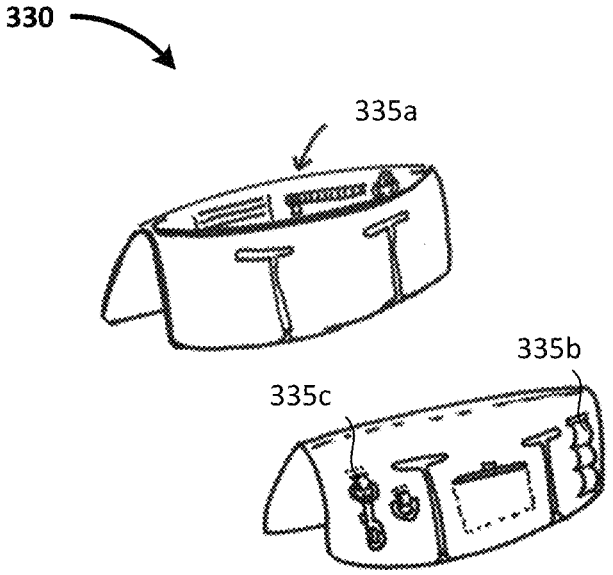
FIG. 3D depicts an exemplary RTC with internal functionality features and external accessories.

FIG. 3D depicts an exemplary RTC 330 with internal functionality features and external accessories. The exemplary RTC 330 includes internal pockets 335*a*. The exemplary RTC includes internal slip pockets. The exemplary RTC includes flap pockets. The exemplary RTC 330 includes hook attachment placements 335*c*. The exemplary RTC may include a label area such that a name tag and/or embroidery may be coupled to the exemplary RTC. The exemplary RTC 330 includes loops 335*b* configured such that the loops may, for example, hold items, such as pens/pencils. In some embodiments, an exemplary RTC may, for example, include a smart phone holder.

Figure 3E:
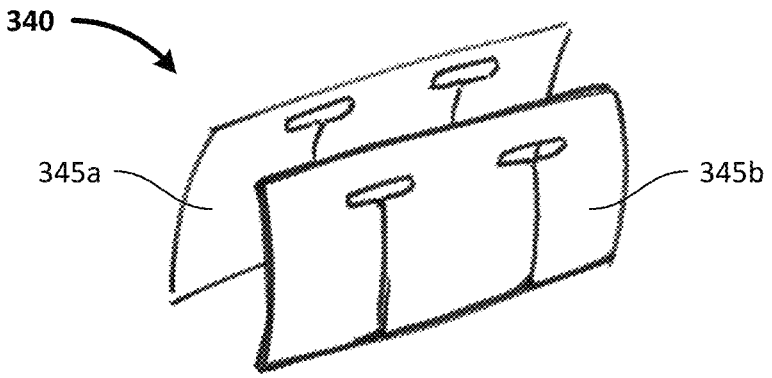
FIG. 3E depicts an exemplary RTC constructed out of two panels.

FIG. 3E depicts an exemplary RTC 340 constructed out of two panels. The exemplary RTC 340 includes a first panel 345*a*. The exemplary RTC 340 includes a second panel 345*b*.

Figure 3F:
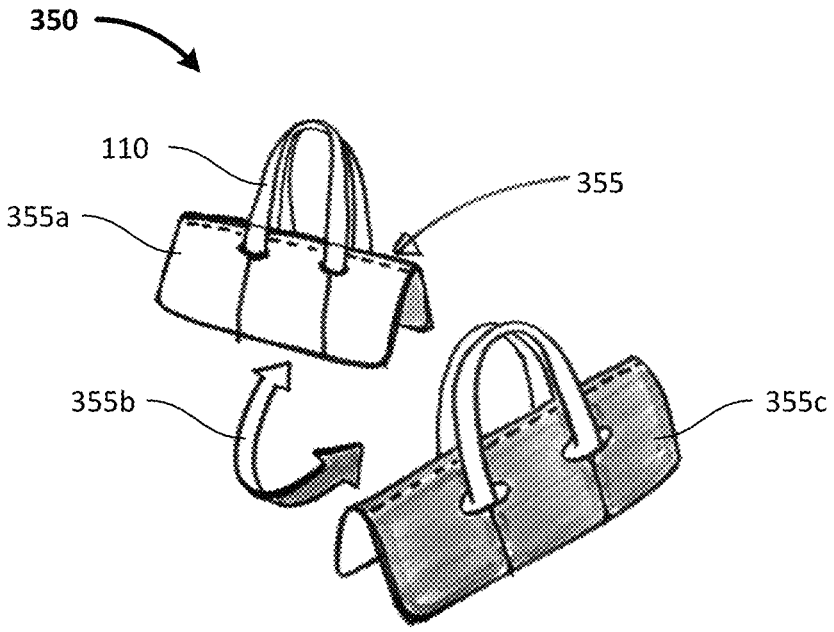
FIG. 3F depicts an exemplary RTC reversibility feature.

FIG. 3F depicts an exemplary RTC 350. The exemplary-RTC 350 includes a reversibility feature 355. The handles 110 of the tote bag may, for example, be inserted into the exemplary RTC 350, wherein a first side of the exemplary RTC is shown on top. The exemplary RTC 355 may, for example, be removed from the handles and be reinserted backwards in with the bottom side of the RTC being shown on top in a process 355*b*. The exemplary RTC 335 may, for example, operate with the RTC bottom side 355*c* being shown on top, because of the reversibility function of the exemplary RTC. One side may, for example, include a first color scheme and/or pattern. The reverse side may, for example, include a second color scheme and/or pattern.

Figure 3G:
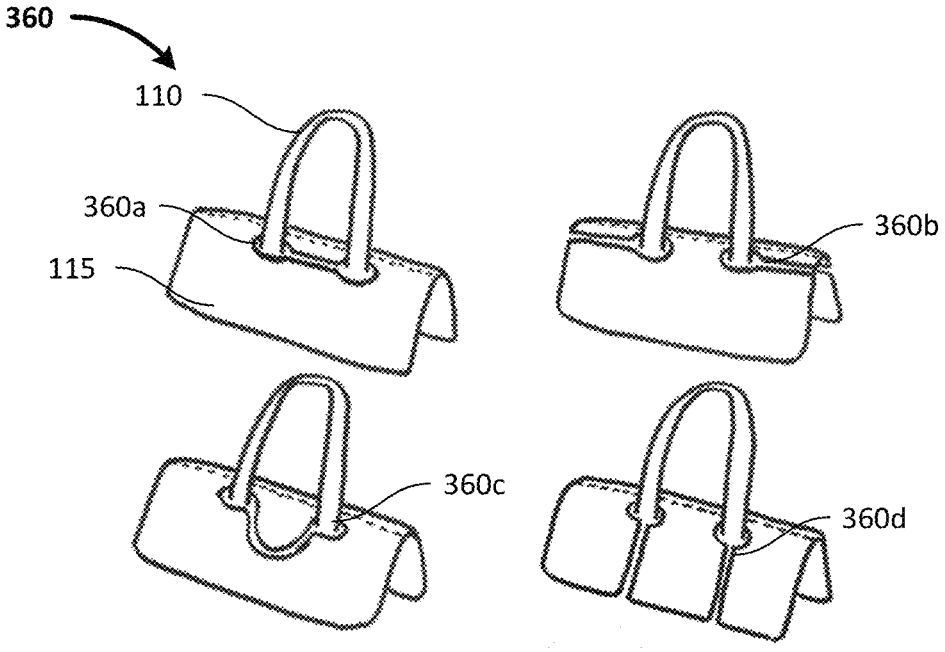
FIG. 3G depicts an exemplary RTC in an illustrative use-case scenario including exemplary placement locations and configurations.

FIG. 3G depicts an exemplary RTC in an illustrative use-case scenario 360 including exemplary placement locations 360 and configurations. The illustrative use-case scenario 360 includes an exemplary RTC 115. The illustrative use-case scenario includes an exemplary handle of a tote bag. The exemplary handle of the tote bag may, for example, be inserted through a handle aperture 360*a*. The handle aperture 360*a* includes a first aperture intended for the handle. The first aperture may, for example, be located at a ⅓ of the length of the exemplary RTC from the left side. The first aperture may, for example, be located at a height ¼ below the top of the first cover. The first aperture may, for example, be located at a height ⅓ below the top of the first cover in some embodiments. The handle aperture 360*a* includes a channel aperture connected to the first aperture. The channel aperture is connected to a second aperture. The channel aperture is constructed to extend along the longitudinal direction of the exemplary RTC horizontally. The second aperture may, for example, be located at a ⅓ of the length of the exemplary RTC from the right side. The second aperture may, for example, be located at a height ¼ below the top of the first cover. The second aperture may, for example, be located at a height ⅓ below the top of the first cover in some embodiments. The channel aperture may, for example, extend along the longitudinal direction of the exemplary RTC. The channel aperture may, for example, height may, for example, be located at a height ¼ below the top of the first cover. The height may, for example, be located a height ⅓ of below the top of the first cover. The first cover and second cover may, for example, include matching apertures similarly configured.

An exemplary RTC includes two handle apertures 360*b* evenly spaced from each other, and each handle aperture extends horizontally to the periphery of the RTC. The channel aperture is constructed to extend along a curved path direction that extends horizontally. An exemplary RTC includes a handle aperture 360*d*. The handle aperture 360*a* includes a channel aperture connected to the first aperture. The channel aperture is connected to a second aperture. An exemplary RTC includes two handle apertures 360*d* evenly spaced from each other, and each handle aperture extends vertically to the periphery of the RTC.

Figure 3H:
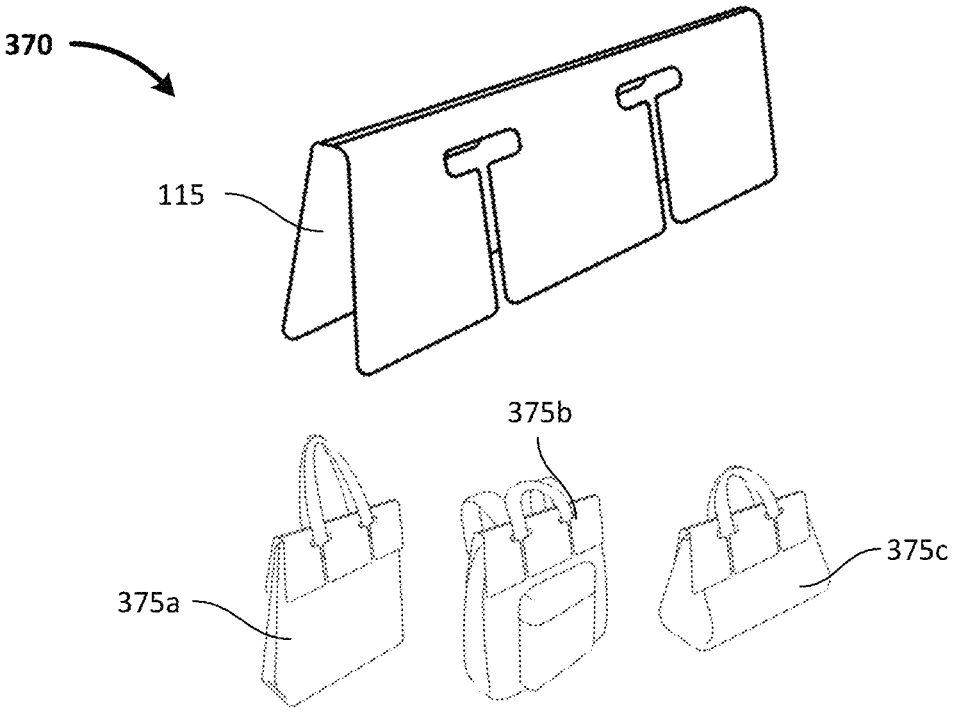
FIG. 3H depicts an illustrative use case scenario depicting an RTC being coupled to some exemplary bags.

FIG. 3H depicts an illustrative use case scenario 370. The illustrative use case scenario includes an RTC 115 being coupled to some exemplary bags. The exemplary bags include a tote bag 375*a*. The exemplary bags include a backpack 375*b*. The exemplary bags include a purse 375*c*.

The handle apertures may, for example, vary to serve different needs of customers such as the type of bag, customer's personal preference in appearance of the bag, and the bag's use in everyday such as being used for a beach bag compared to being used on a purse.

Figure 4A:
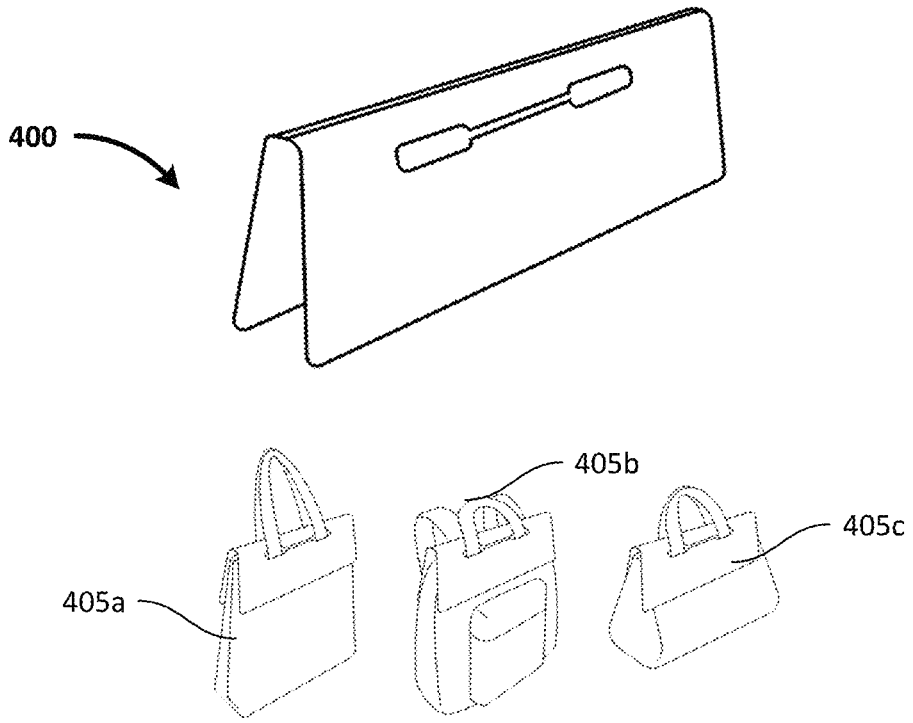
FIG. 4A depicts an exemplary RTC along with perspective views of the exemplary RTC being coupled with different exemplary bags.

FIG. 4A depicts an exemplary RTC 400 along with perspective views of the exemplary RTC being coupled with different exemplary bags. The exemplary bags include an exemplary tote bag 405*a*. The exemplary bags 400 include a backpack 400*b*. The exemplary bags 400 include a purse 400*c*.

The detachable cover as depicted in FIG. 4A, is depicted with one handle aperture that is configured such that a first portion of the handle aperture is connected to a second portion of the handle aperture by a channel aperture.

Figure 4B:
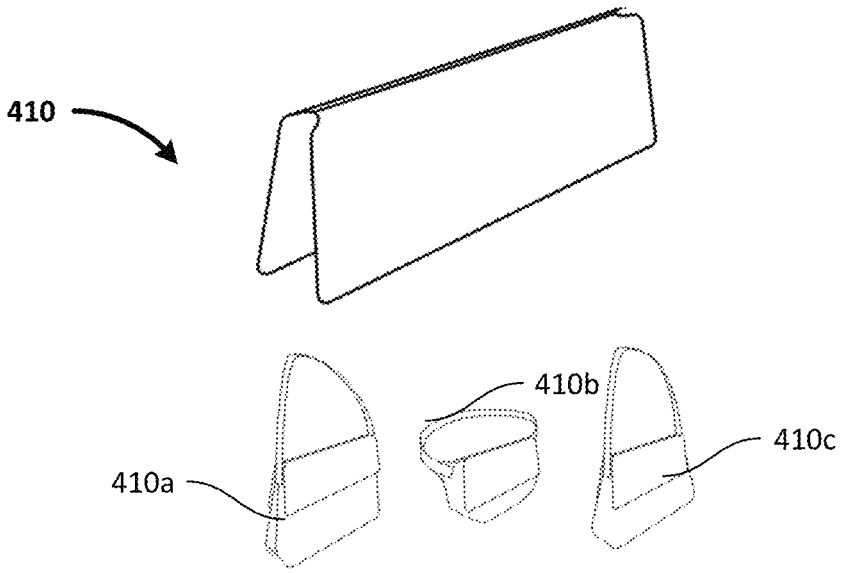
FIG. 4B depicts an exemplary RTC along with perspective views of the exemplary RTC being coupled with different exemplary bags.

FIG. 4B depicts an exemplary RTC 410 along with perspective views of the exemplary RTC being coupled with different exemplary bags. The exemplary bags include an exemplary tote bag 405*a*. The exemplary bags 400 include a backpack 400*b*. The exemplary bags 400 include a purse 400*c*.

Figure 5A:
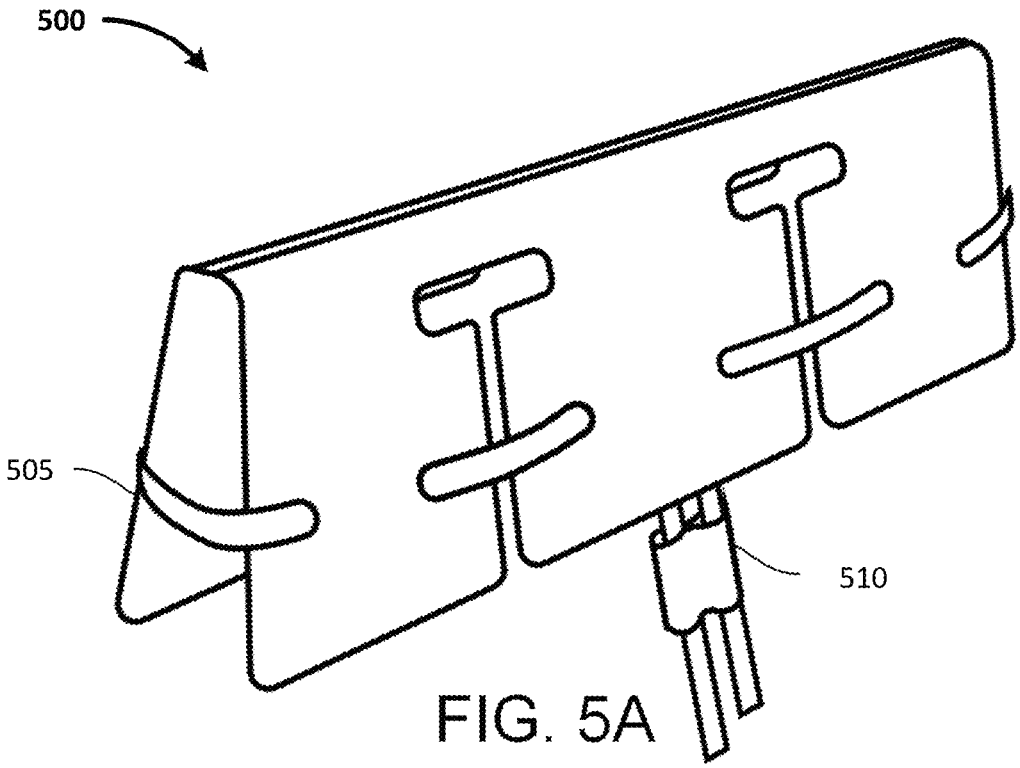
FIG. 5A depicts an exemplary RTC along with an exemplary tassel configuration.

FIG. 5A depicts an exemplary RTC 500 along with an exemplary tassel configuration. The exemplary RTC 500 includes a lacing 505 that may, for example, be interlaced through lacing apertures spaced out on the exemplary RTC across the exemplary RTC. The exemplary RTC 500 includes an exemplary tassel 510. The exemplary tassel may, for example, be used to couple the ends of the lacing.

Figure 5B:
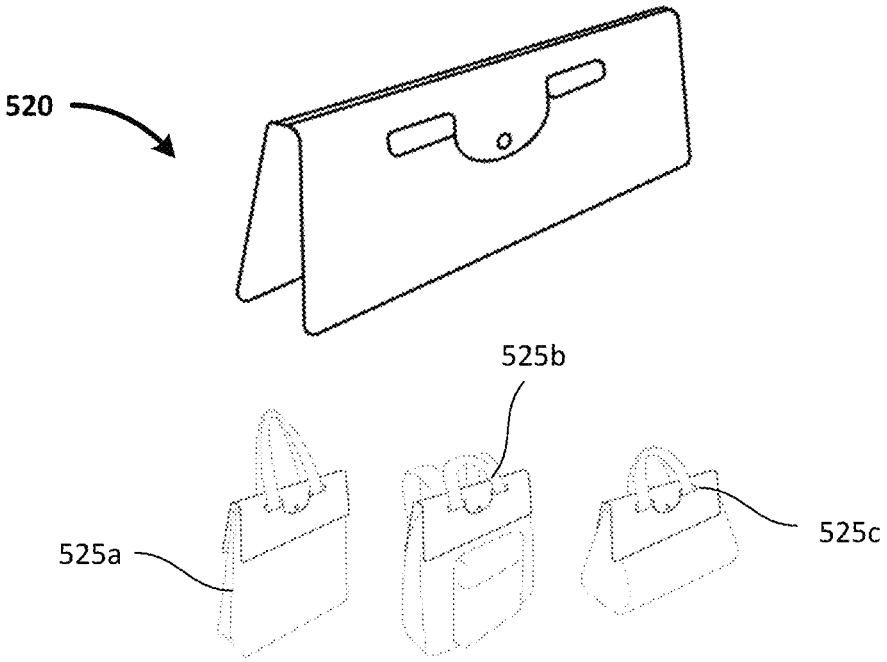
FIG. 5B depicts an exemplary RTC along with perspective views of the exemplary RTC being coupled with different exemplary bags.

FIG. 5B depicts an exemplary RTC 520 along with perspective views of the exemplary RTC being coupled with different exemplary bags. The exemplary bags include an exemplary tote bag 525*a*. The exemplary bags include a backpack 525*b*. The exemplary bags include a purse 525*c*.

Some embodiments may, for example, include a tote cover as depicted in FIG. 4B. The separate handle apertures may, for example, be interconnected to each other as depicted in FIG. 4A. An independent flap may, for example, with an attachment mechanism may, for example, be placed between the separate handle apertures as depicted in FIG. 5B.

Figure 6A:
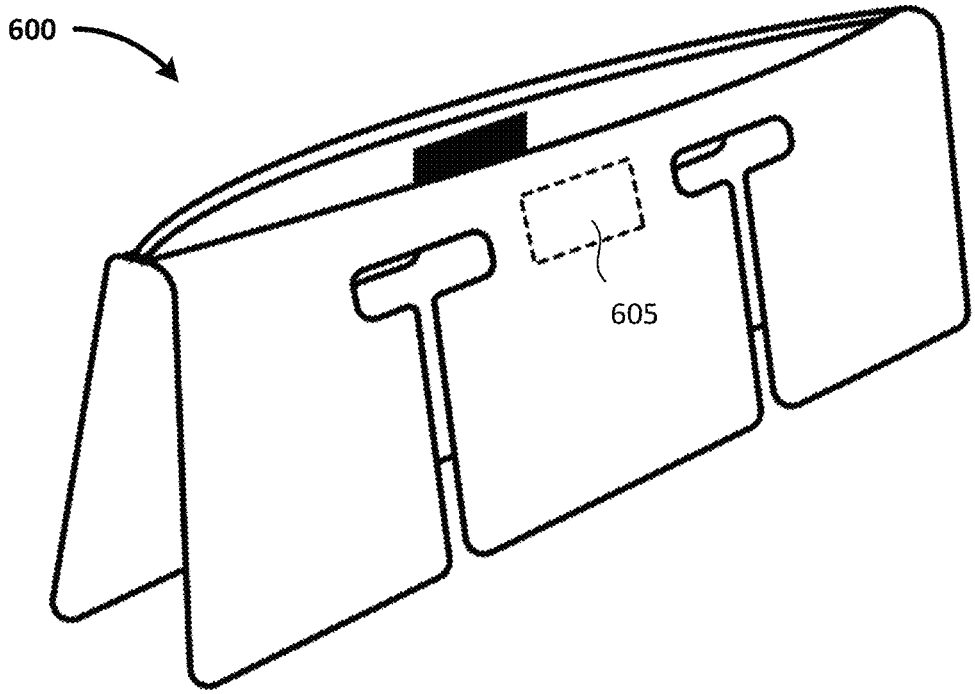
FIG. 6A depicts an exemplary RTC alongside an embroidery region.

FIG. 6A depicts an exemplary RTC 600. The exemplary RTC 600 includes an embroidery region 605. The embroidery region may, for example, be used for an insertable name plate. The embroidery region may, for example, be used for an insertable insignia. The exemplary secondary square aperture may, for example, be used to show an engraving configured to the bag, such as an embossed name plate. The embroidery region may, for example, be used for insertable metal plates including the initial of a user (e.g., A.A., D.C, T.S., C.T., etc.). The circle closure apertures may, for example, be configured with closure mechanisms (e.g., buttons).

Figure 6B:
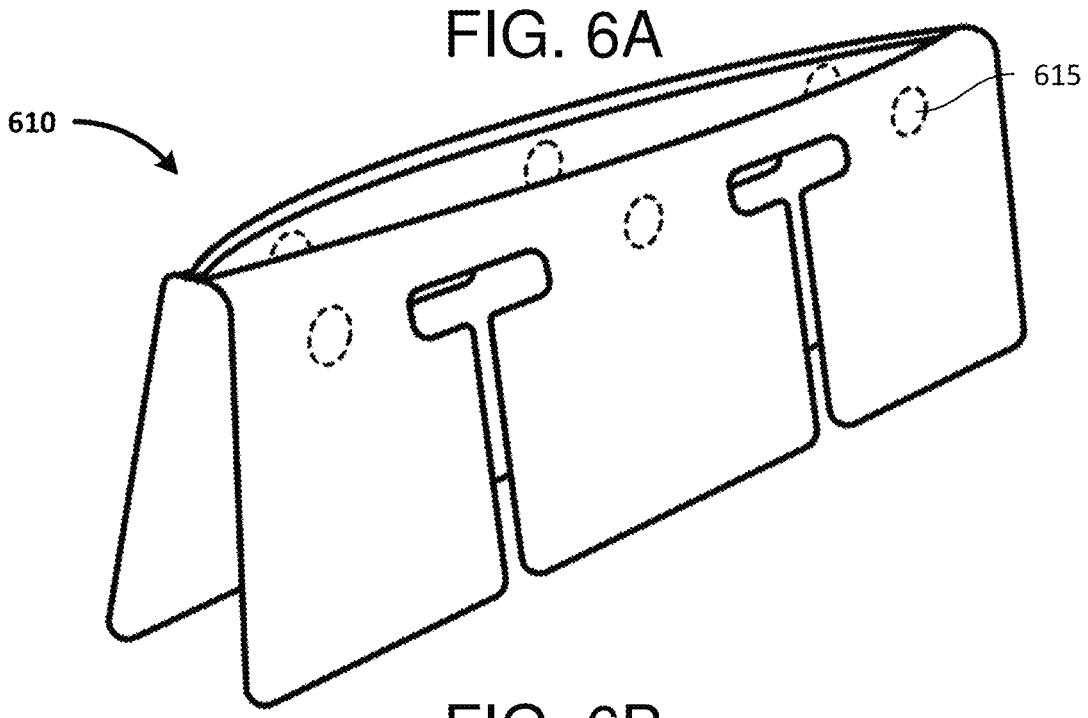
FIG. 6B depicts an exemplary RTC alongside exemplary secondary circle closures configuration.

FIG. 6B depicts an exemplary RTC alongside exemplary secondary circle apertures. The circle apertures may, for example, accommodate the bags features such as exterior snaps and/or external clasps. For example, an exemplary bag may, for example, insert snaps through the exemplary secondary apertures and then couple with an external receiver snap such that the snaps provide additional coupling security to the exemplary RTC and bag. The snaps may, for example, be screwed on and/or snapped on.

Figure 7A:
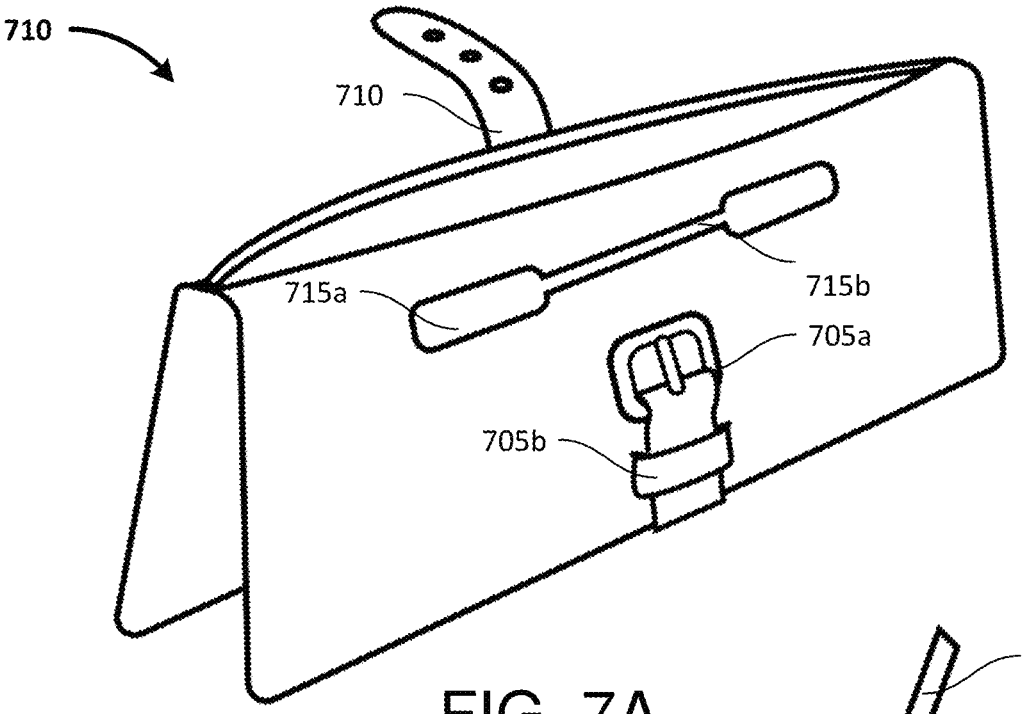
FIG. 7A depicts an exemplary RTC with a strap and buckle configuration.

FIG. 7A depicts an exemplary RTC 710 with a strap and buckle configuration. The exemplary RTC 710 includes a buckle 705*a*. The buckle 705*a* may, for example, be coupled to the exemplary RTC by a strap 705*b*. The exemplary RTC may, for example, include a leather strap 710. The leather strap may, for example, include predetermined apertures configured such that the buckle may, for example, couple the strap to the buckle. The exemplary RTC includes a handle aperture 715*a*. The exemplary RTC includes a channel aperture 715*b* used to couple the exemplary handle aperture together.

Figure 7B:
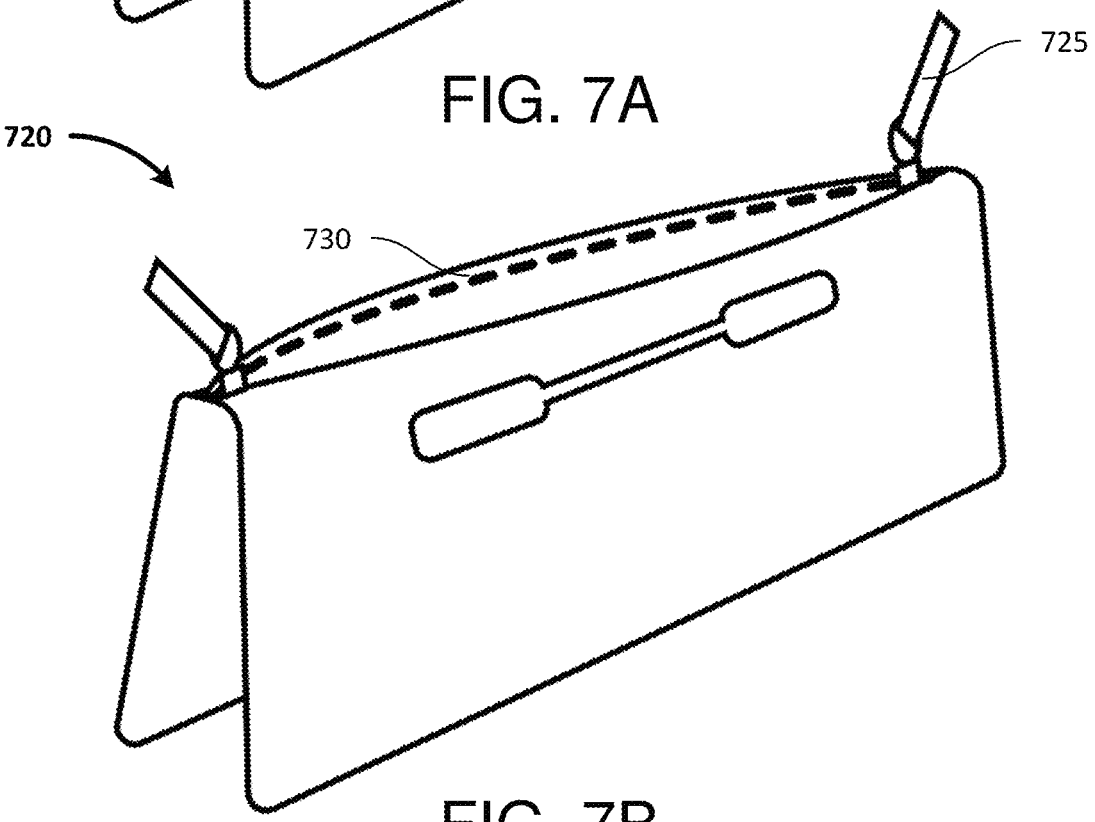
FIG. 7B depicts an exemplary RTC with an exemplary zipper configuration.

FIG. 7B depicts an exemplary RTC 720 with an exemplary zipper configuration. The exemplary RTC 720 includes a zipper 725. The exemplary RTC 720 includes a zipper path 730. The zipper may, for example, be operated on the zipper path to close the exemplary RTC.

Figure 8A:
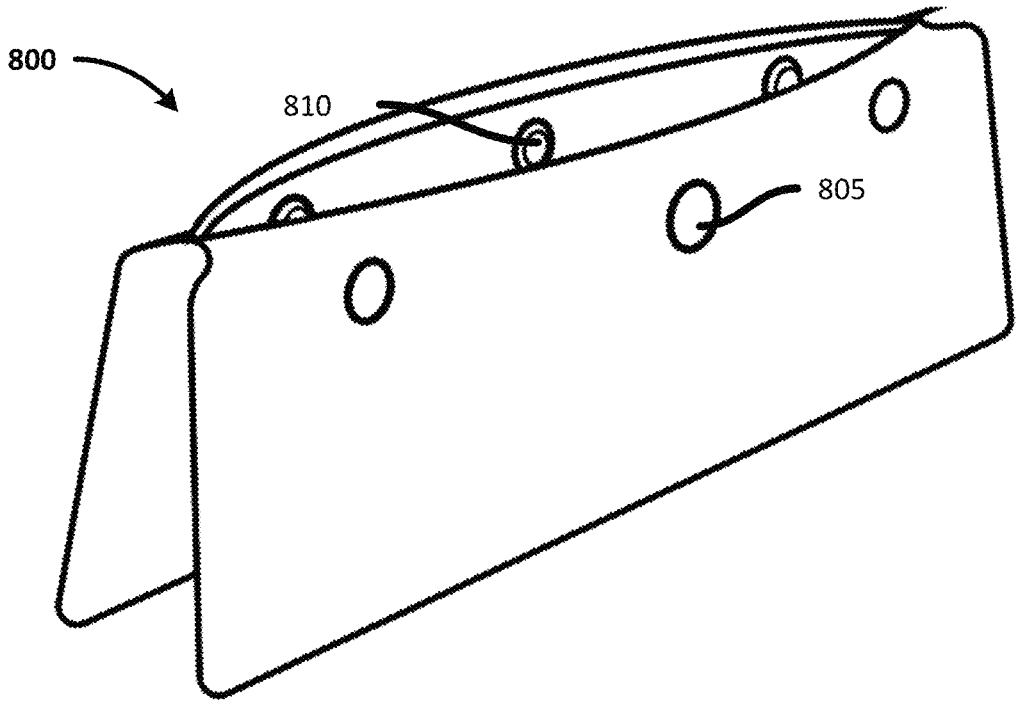
FIG. 8A depicts an exemplary RTC with an exemplary snap configuration.

FIG. 8A depicts an exemplary RTC with an exemplary snap configuration 800. The exemplary snaps configuration 800 includes a snap receiver 805. The exemplary snap configuration 800 includes a snap insert 810. The snap insert may, for example, be inserted into the receiver to couple the first cover to the second cover of the exemplary RTC. The snap receiver may, for example, be an edge of the leather of the RTC. The snap receiver may, for example, be a metal snap. The snap receiver may, for example, be a plastic snap. The insert may, for example, be metal. The insert may, for example, be plastic.

Figure 8B:
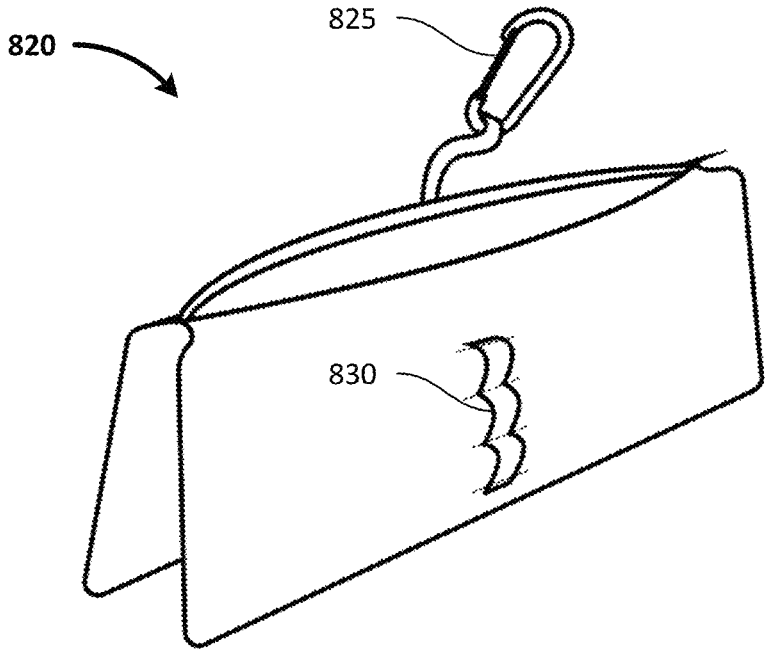
FIG. 8B depicts an exemplary RTC with an exemplary carabiners and loop configuration.

FIG. 8B depicts an exemplary RTC with an exemplary carabiners and loop configuration 820. The carabiner and loop configuration includes a carabiner 825. The carabiner and loop configuration includes loops 830. The carabiner may, for example, be used to operate the exemplary RTC to close and/or open by the coupling or decoupling of the carabiner to the loops. The exemplary RTC may, for example, be closed securely by using the loop closest to the bottom. The exemplary RTC may, for example, be lightly closed by using the loop at the top. The secureness of the closure may, for example, be affected by the length of the cord, the type of carabiner, and the placement of the loops, and the number of the loops.

Figure 9A:
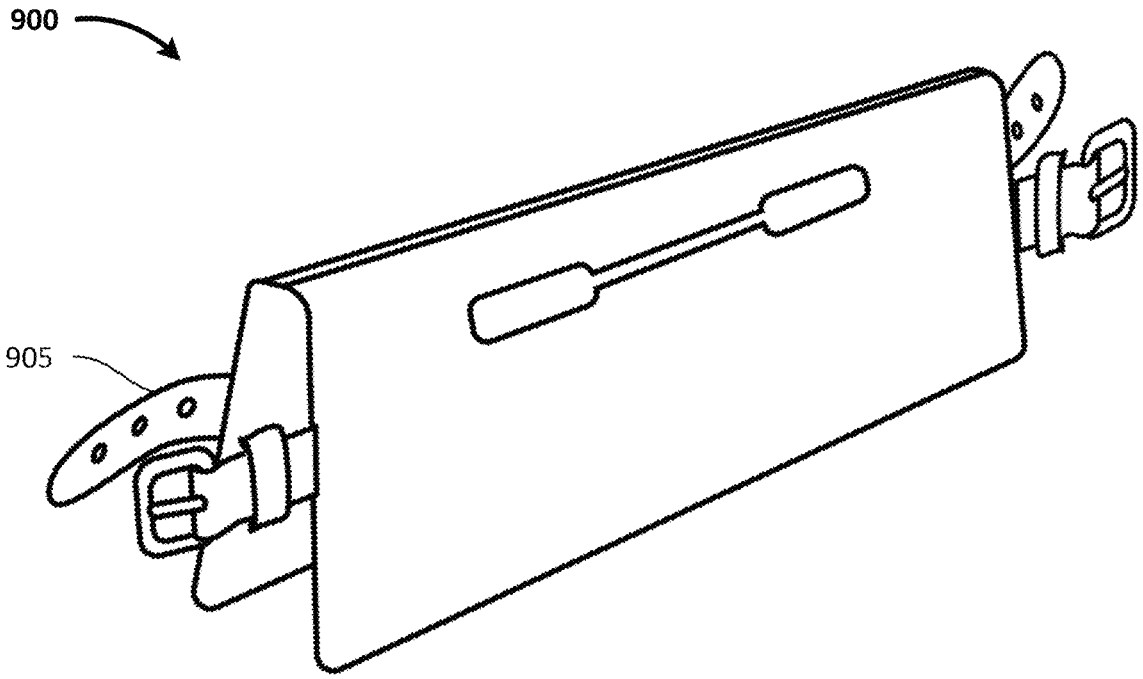
FIG. 9A depicts an exemplary RTC along with an exemplary buckle configuration.
Figure 10A:
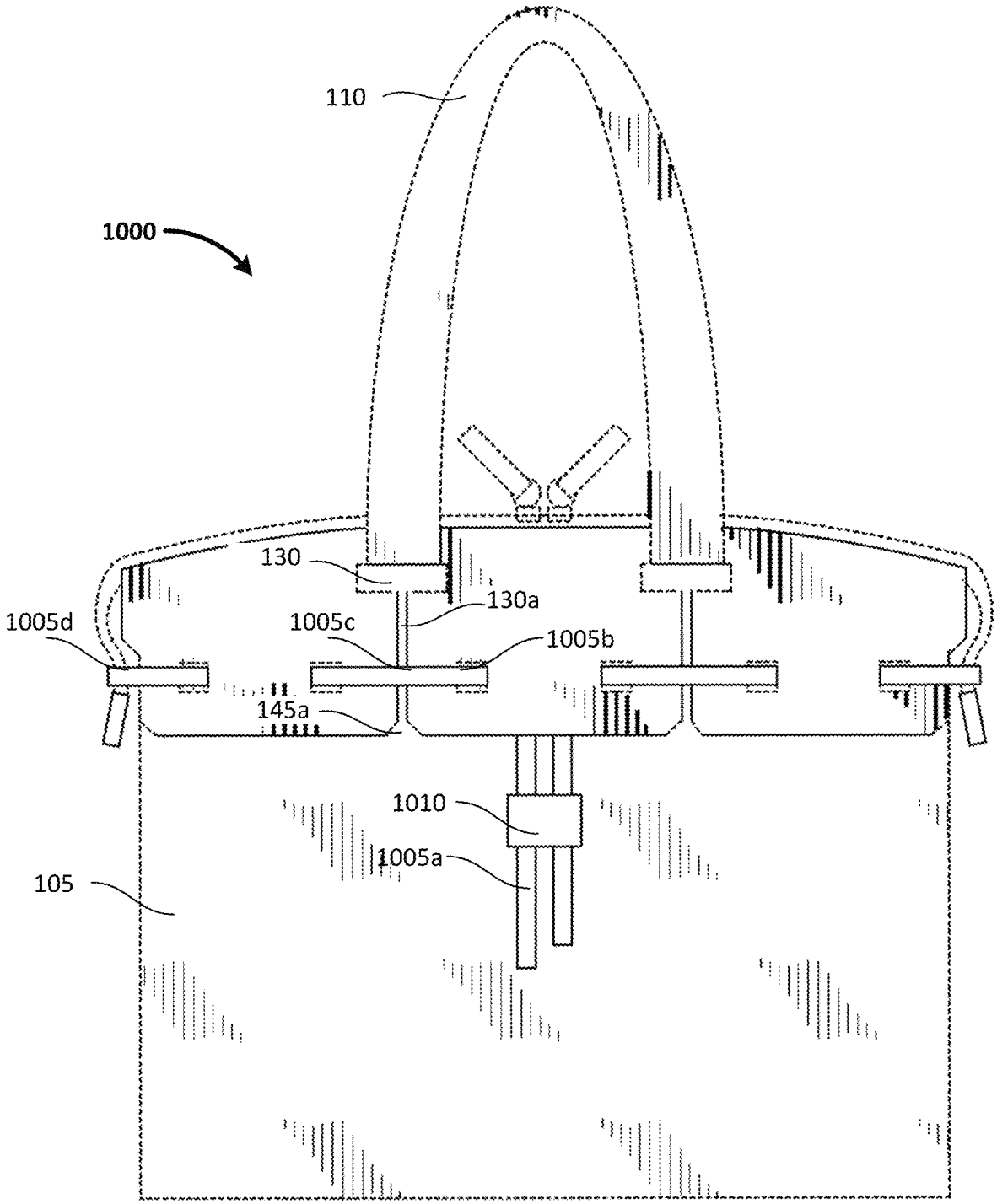
FIG. 10A depicts an exemplary RTC coupled to an exemplary bag.
Figure 10B:
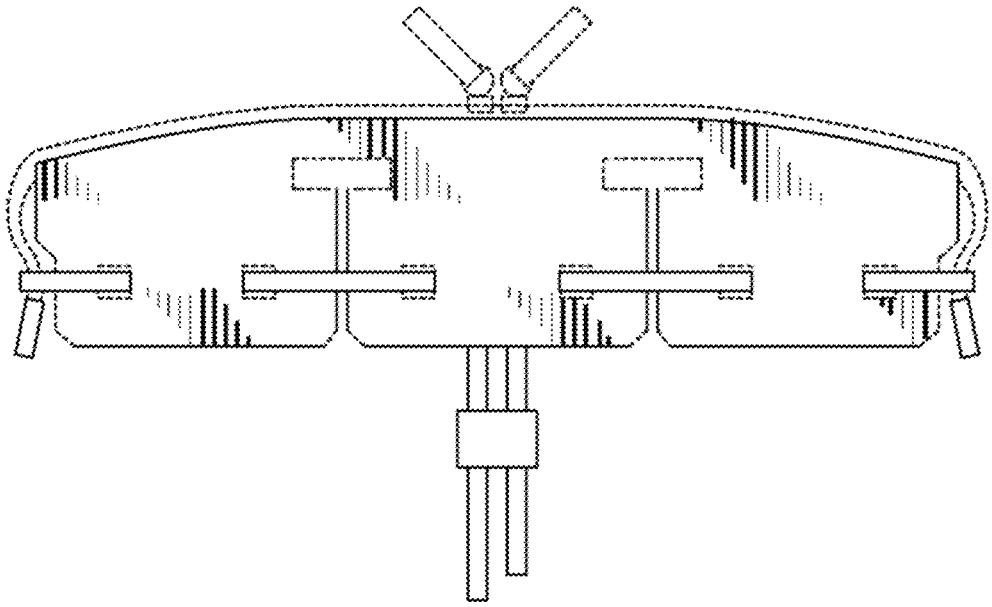
FIG. 10B depicts a front view of an exemplary RTC.
Figure 10C:
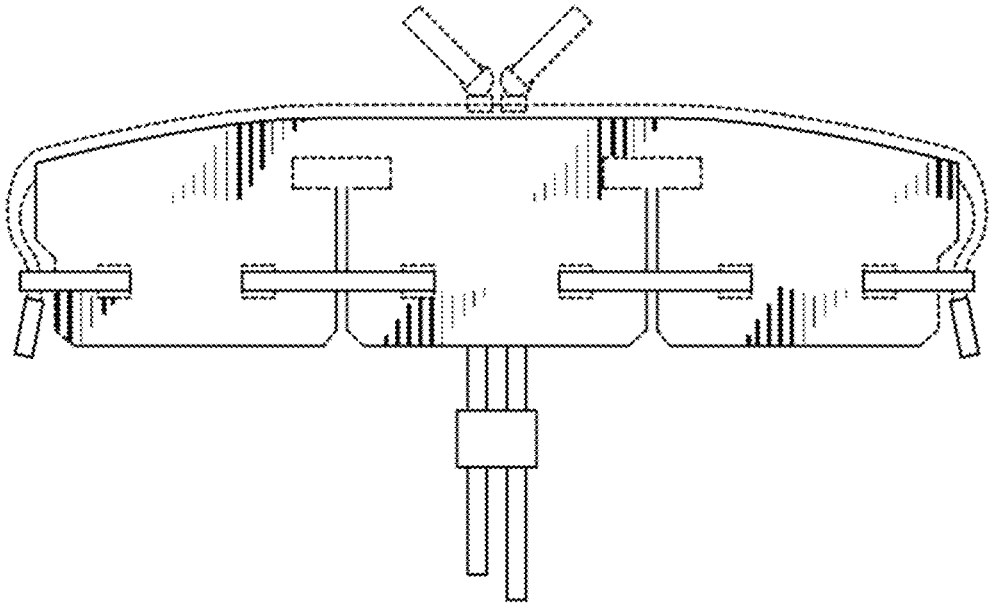
FIG. 10C depicts a back view of an exemplary
Figure 10D:
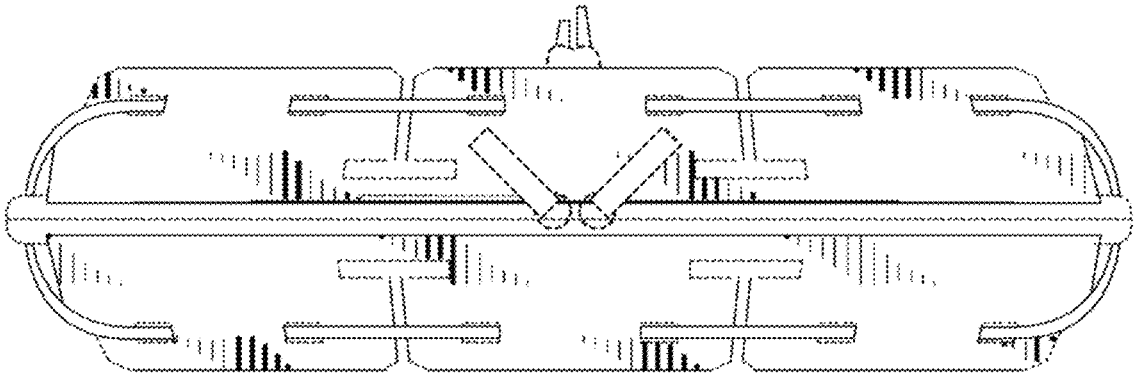
FIG. 10D depicts a top view of an exemplary RTC flattened.

FIG. 9A depicts an exemplary RTC along with an exemplary buckle configuration 900. The exemplary buckle configuration 900 includes a buckle and a strap combination 905.

Figure 9B:
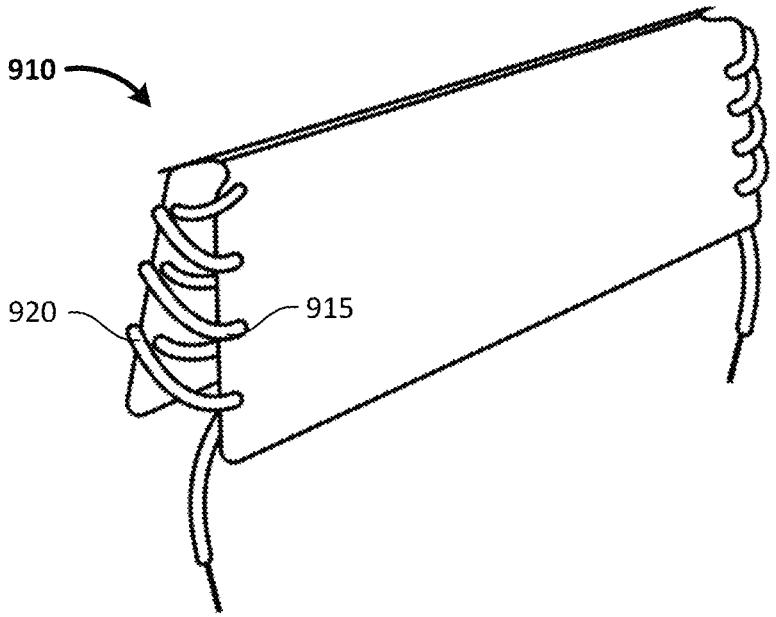
FIG. 9B depicts an exemplary RTC along with an exemplary tassel configuration.

FIG. 9B depicts an exemplary RTC along with an exemplary cord configuration 910. The exemplary cord configuration may, for example, be used to prevent contents from the bag from sliding out the side. The exemplary cord configuration may, for example, be used on a tote bag that is used for going to the beach. The exemplary cord configuration includes cord apertures 910. The exemplary cord configuration includes cord 920. The cord may, for example, be inserted through the cord apertures to couple the first cover of the exemplary RTC to the second cover of the exemplary RTC. The coupling may, for example, be configured such that the handle of the bag is secured to the exterior of the RTC by the cord.

FIGS. 10A-11 depict a schematic of an exemplary RTC 1000 coupled to an exemplary bag. FIG. 10A depicts a front view of the exemplary RTC while being coupled to a tote bag. FIG. 10B depicts a front view of the exemplary RTC by itself. FIG. 10C depicts a back view of the exemplary RTC. FIG. 10D depicts an exemplary top view of the exemplary RTC laid flat. FIG. 10E depicts an exemplary bottom view of the exemplary RTC laid flat. FIG. 10F depicts a perspective view of the exemplary RTC by itself. FIG. 10G depicts a first side view of the exemplary RTC. FIG. 10H depicts a second side view of the exemplary RTC, opposite to the side view depicted in FIG. 10G. FIG. 11 depicts an exemplary RTC coupled to a tote bag in a perspective view.

FIG. 10 A & FIG. 10 E depict a schematic of an exemplary RTC 1000. The schematic includes a bag 105. The bag includes handles 110. The exemplary schematic 1000 includes a lacing 1005. The lacing 1005 includes a first end 1005*a*. The exemplary schematic 1005 includes secondary lacing apertures 1005*b*. The lacing 1005 may, for example, be threaded through the secondary lacing apertures 1005*b* as depicted. The lacing may, for example, be threaded traversely across 1005*c* the channel of the handle aperture.

The exemplary schematic includes two handle apertures 130. The handle apertures 135 include channels 130*a*. The channels may, for example, be used to guide the handle of an existing bag through to the interior of the handle aperture. The interior of the handle aperture may, for example, be wider than the channel aperture. The handles of the existing bag may, for example, be threaded through an opening 145*a* of the channel aperture 130*a*. The opening of the channel aperture 145*a* may, for example, be situated on the periphery 140 of the opposing covers.

The exemplary schematic includes a first portion. The first portion may, for example, be divided into segments by the handle apertures. The first portion includes a left segment 135*a*. The first portion includes a middle segment 135*b*. The first portion includes a right segment 135*c*.

The exemplary schematic includes a second portion. The second portion may, for example, be divided into segments by the handle apertures. The second portion includes a left segment 150*a*. The first portion includes a middle segment 150*b*. The first portion includes a right segment 150*c*.

The left segment, middle segment, and right segment of the first portion and second portion of the exemplary RTC include secondary lacing apertures aligned along an axis parallel to the longitudinal axis of the exemplary RTC. The longitudinal axis of the exemplar RTC may, for example, be seen as align with an opening path of the middle portion of the exemplary RTC.

The exemplary RTC schematic 1000 includes a middle portion. The middle portion is situated between the first portion and second portion of the exemplary RTC. The middle portion includes a first foldable crease 145*a* separating the second top portion cover from the middle portion. The middle portion includes a second foldable crease 145*b* separating the first bottom portion cover from the middle portion. The middle portion includes a opening path segment 145*c* situated along the extending longitudinal axis of the exemplary RTC. The middle portion may be engaged in an opening mode by operating a closure mechanism to decouple an opening path segment 145*c* between a first portion of the middle path and a second portion of the middle path to form a middle portion opening aligned with the opening of an existing bag. The opening path may be closed with the closure mechanism by coupling the opening path segment of the first portion of the middle path together with the second portion of the middle path by operating the closure mechanism. The first portion of the middle path is located between the opening path 145*c* and the second foldable crease 145*b*. The second portion of the middle path is located between the opening path and the first foldable crease 145*a*.

The middle portion includes a lacing tab 145. The lacing tab may, for example, be used to couple the first portion of the middle path to the second portion of the middle path while the opening path segment is opened and/or closed by the closure mechanism. The lacing tab 145*d* allows lacing 1005*d* to be threaded through or around the lacing tab to secure the opposing sides of the cover together.

The lacing 1005 may, for example, be threaded through the secondary apertures of the left, middle, right segments, and lacing tabs (e.g., in order of one end of lacing begins in middle segment of bottom cover, left segment of bottom cover, left lacing tab, left segment of top cover, middle segment of top cover, right segment of top cover, right lacing tab, right bottom segment, and second end ends at middle segment of bottom cover). The lacing of the two ends may, for example, then be coupled by a tassel 1010 as depicted. Other coupling mechanisms (e.g., knots, buckles, sticking) may, for example, be used to secure the two ends of the lace together.

Figure 12:
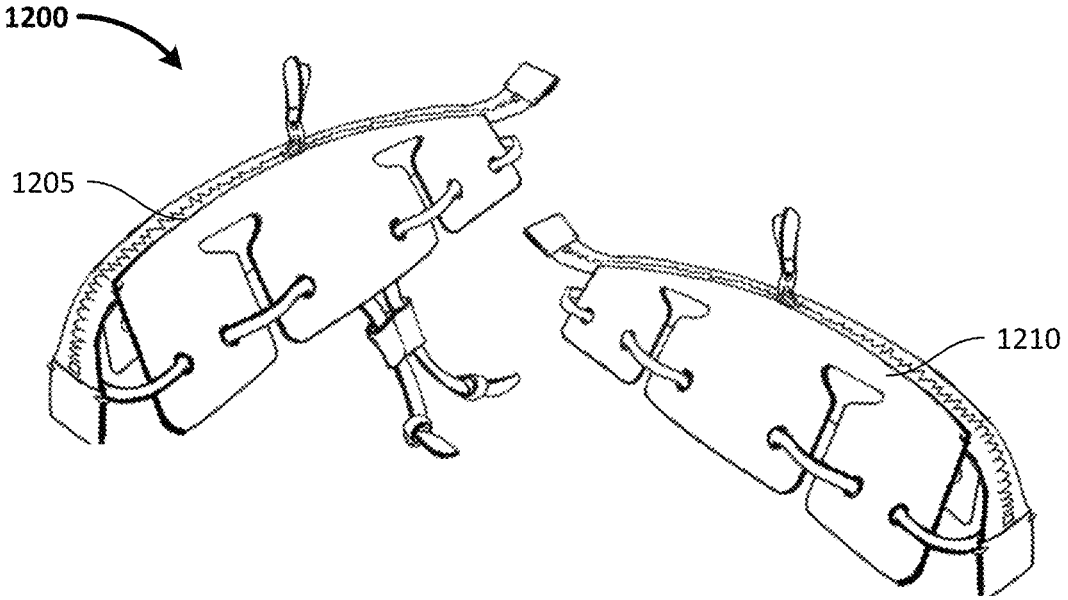
FIG. 12 depicts an exemplary front and back view of an exemplary RTC.

FIG. 12 depicts an exemplary RTC along with perspective views 1200 of the exemplary RTC. The perspective views 1200 includes a front view 1205. The perspective views include a back view 1210.

Figure 13:
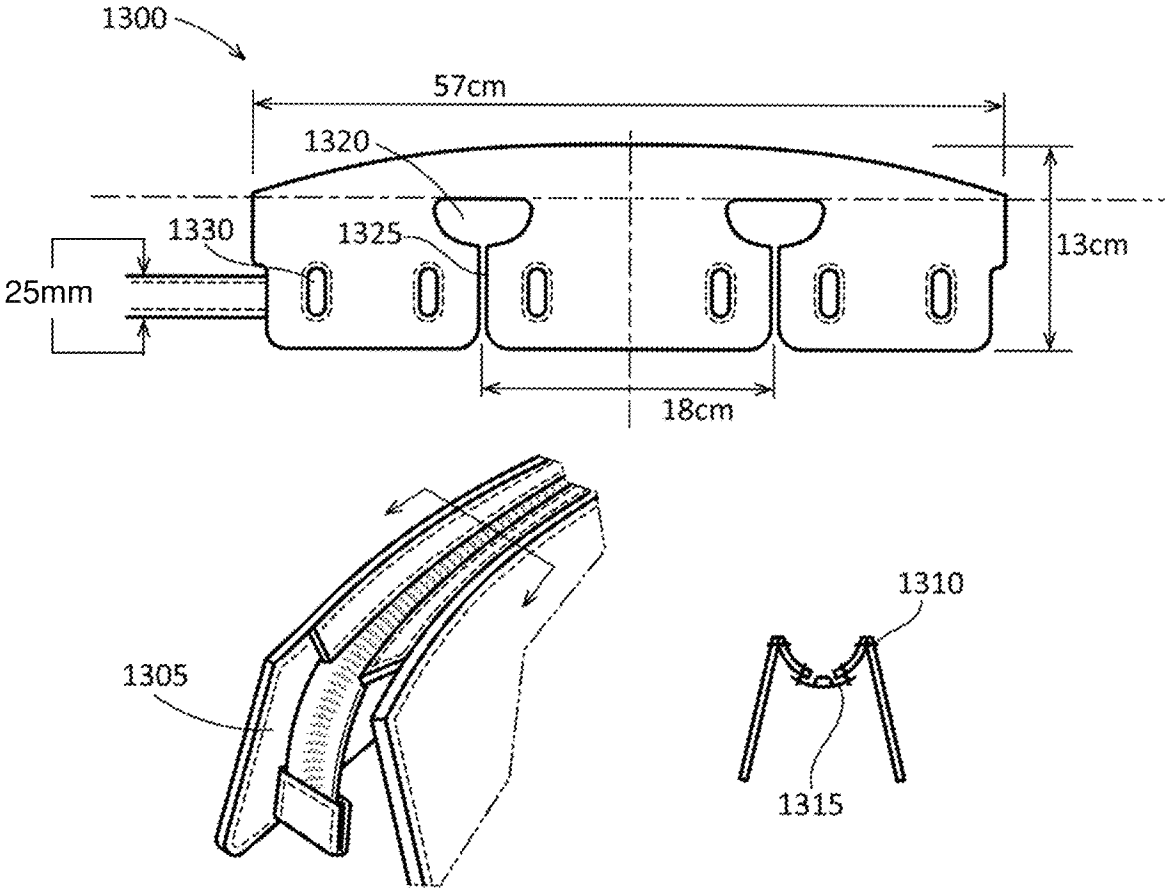
FIG. 13 depicts an exemplary belt and zipper RTC configuration with exemplary dimensions.

FIG. 13 depicts an exemplary belt and zipper RTC configuration 1300 with illustrative dimensions. The exemplary RTC 1300 includes a zipper mechanism 1305. The zipper mechanism 1305 may, for example, include a zipper path 1315. The zipper mechanism 1305 includes a concave 1310 such that the zipper path and/or zipper mechanism may, for example, be protected by the exterior RTC when closed.

The exemplary RTC includes a handle aperture 1320. The handle aperture may, for example, be configured to partially enclose the handle of an exemplary bag. The exemplary RTC configuration 1300 includes a channel aperture 1325. The channel aperture may, for example, be positioned between the handle aperture and the periphery of the RTC.

The exemplary RTC may, for example, include by way of example, but not in limitation a length dimension of 57 cm. The exemplary RTC may, for example, include a height of 13 cm. The spacing between the handle apertures may, for example, be 18 cm. The handle apertures may, for example, include a semi-circle concave with a diameter of 6 cm located along the longitudinal axis. The longitudinal axis may, for example, be positioned two-thirds above the peripheral edge of the RTC. The longitudinal axis may, for example, be positioned a one-third from the top of the exemplary RTC.

The exemplary RTC may, for example, fit 13 mm wide lace. The exemplary RTC may, for example, include belt slots and fit a 25 mm belt. The exemplary RTC may, for example, include suede on its sides. The exemplary RTCs top may, for example, crest 2 cm downward such that a zipper or closing module may, for example, be employed within the tote bag and exemplary RTC configuration. The downward position may, for example, hide the zipper from view and protect the zipper by enclosing it between two flaps when closed.

Figure 14:
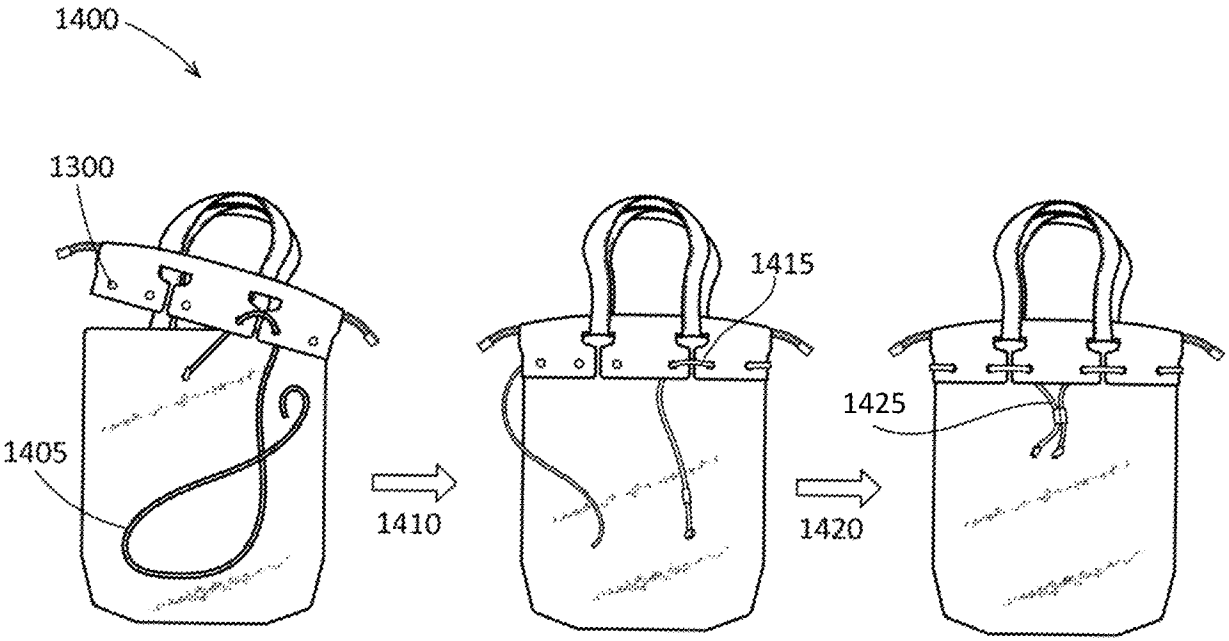
FIG. 14 depicts an exemplary method of coupling an RTC to an exemplary tote bag.
Figure 15A:
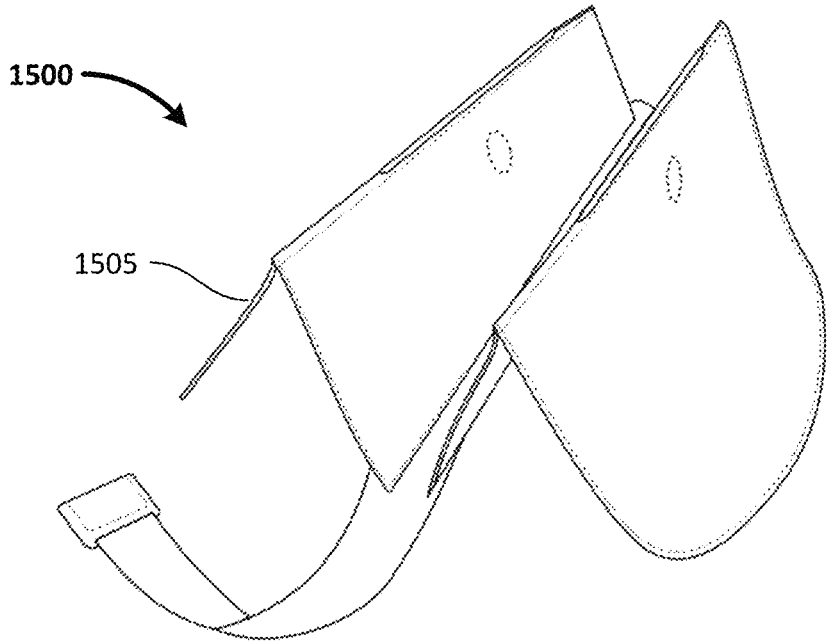
FIG. 15A depicts a perspective view of an exemplary RTC.
Figure 15B:
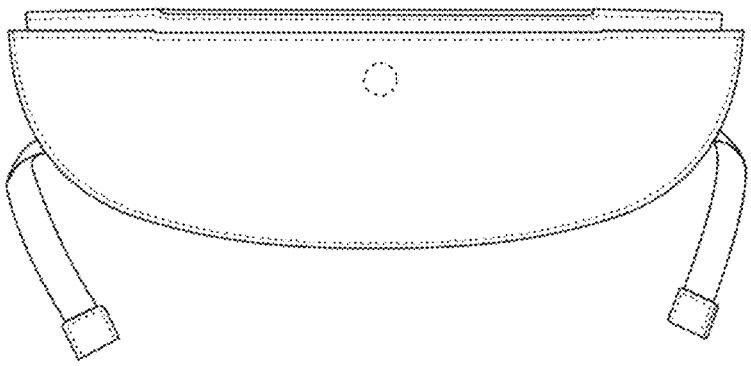
FIG. 15B depicts a front view of an exemplary RTC, the back view may, for example, the reverse of the front view.
Figure 15C:
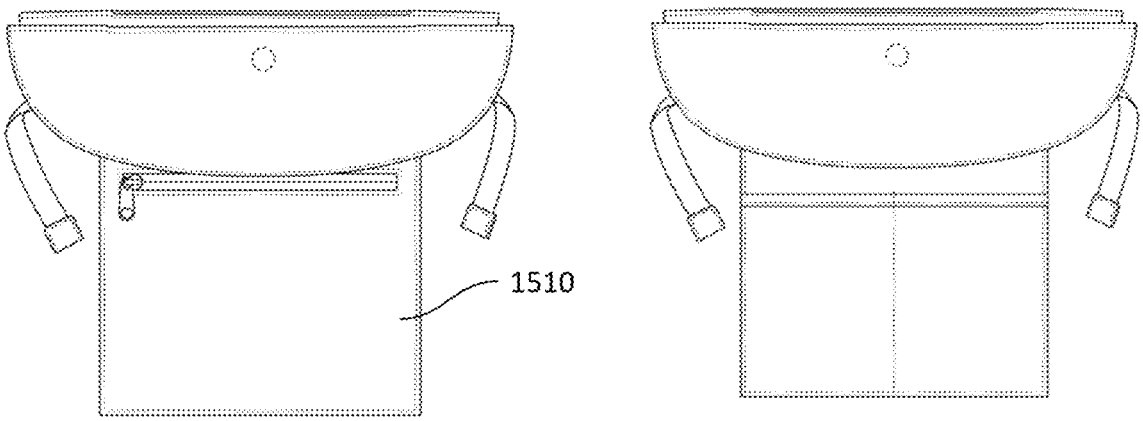
FIG. 15C depict a perspective view of an exemplary RTC with a sub accessory insert.
Figure 15D:
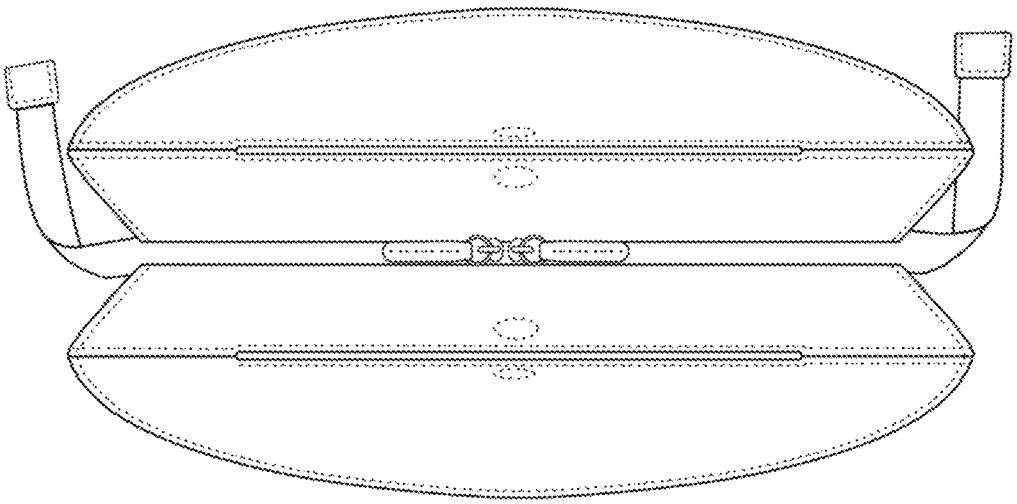
FIG. 15D depicts a top view of an exemplary RTC.

FIG. 14 depicts an exemplary RTC 1300 with an exemplary lacing coupling method 1400. The lacing process includes a lacing process 1410 wherein the handles are threaded through the handle apertures of the exemplary RTC. The lacing process 1410 may, for example, include lace 1415. The lacing process may, for example, include threading the lace through a secondary aperture. The secondary apertures may, for example, include metallic loops that maintain the shape of the secondary over a duration of use of the RTC. The lacing process may, for example, include threading the lace through all and/or some of the secondary loops. The lace may, for example, include 13 mm lace. The next step in the lacing process includes a coupling process 1420. The coupling process may, for example, use a tassel 1425 or a coupling mechanism to couple the laces together. The lacing process may, for example, include tying a known (e.g., a square knot, etc.) between the two laces. The lacing process may, for example, include decoupling the exemplary RTC and coupling to a different bag, that the user may, for example, like to use instead of the first chosen bag. FIG. 15C depicts an exemplary RTC with an exemplary coupling method to a series exemplary bag with a tassel attachment mechanism.

FIG. 15A-15D depict an exemplary RTC 1500. The exemplary 1500 includes double covers 1505 for each opposing cover. The double cover may, for example, include a first subcover and a second subcover. The exemplary RTC includes a sub aperture extending along a longitudinal axis of the dual cover of the between the first sub cover and second cover. The sub aperture may, for example, be included in the first double cover and second double cover of the exemplary RTC 1500. The exemplary RTC 1500 includes an exemplary interior accessory that may, for example, be inserted into a bag. The interior accessory may, for example, be used as an interior pocket for the bag. The bag may, for example, be a tote bag. The interior accessory may, for example, provide support and structure to the tote bag's fabric.

In some embodiments, an exemplary RTC may, for example, include metal zips. The exemplary RTC may, for example, include an inner facing of leather. The exemplary RTC may, for example, use ultra suede. The different RTC embodiments may, for example, include different color embodiments.

In an illustrative aspect, some embodiments may, for example, include a removable bag cover including a detachable cover extending along a longitudinal axis and configured to cover an opening into an existing bag including at least one handle, including: a first side cover portion; a second side cover portion; a middle portion between the top cover portion and the bottom cover portion, the middle portion: (a) configured to facilitate folding such that the top cover portion and the bottom cover portion overlay each other to form opposing sides, and (b) including a continuous opening on opposing ends, such that the detachable cover may be placed over an existing handle attached to a bag at both ends of the handle without removing the handle of the existing bag; and at least one handle aperture through each of the opposing sides, the at least one handle aperture configured such that at least one handle of the existing bag is received through a channel portion of the at least one handle aperture extending to a peripheral edge of the opposing covers while both ends of the handle remain coupled to the bag; wherein, the opposing sides further include at least one secondary lacing aperture on either side of each of the at least one handle aperture and parallel to the longitudinal axis, the at least one lacing aperture configured such that a lacing member may be threaded through the secondary apertures to couple together segments on either side of the handle apertures such that the lacing member traverses the channel portion of the at one least channel retaining the at least one handle of the existing bag within the at least one handle aperture when the detachable cover is coupled to the existing bag (as depicted in at least FIGS. 5A, 10A-10H, and FIG. 11).

In some embodiments, the removable bag cover may, for example, further include an aperture closure module configured to selectively provide access into the existing bag through the detachable cover along the opening path segment (as depicted in at least FIGS. 10A-10E, and FIG. 11). In some embodiments, the removable bag cover may, for example, be configured such that the aperture closure module includes a zipper configured to operate along the opening path segment (as depicted in at least FIGS. 5A, 10A-10H, and FIG. 11).

The removable bag cover may, for example, further include a coupling module configured to releasably fasten the detachable cover to the existing bag. (as depicted in at least FIGS. 10A-10E, and FIG. 11). The coupling module may, for example, include a lacing member and the lacing may, for example, be threaded through the opposing covers to securely couple the detachable cover to the existing bag (as depicted in at least FIGS. 5A, 10A-10H, FIG. 11, and FIG. 14).

In an illustrative aspect, some embodiments may, for example, include a removable bag cover including a detachable cover extending along a longitudinal axis and configured to cover an opening into an existing bag including at least one handle, including: a first side cover portion; a second side cover portion; a middle portion between the top cover portion and the bottom cover portion, the middle portion is configured to facilitate folding such that the top cover portion and the bottom cover portion overlay each other to form opposing sides; and at least one handle aperture through each of the opposing sides, the at least one handle aperture configured such that at least one handle of the existing bag is received through a channel portion of the at least one handle aperture while both ends of the handle remain coupled to the bag (as depicted in FIGS. 1, 3A, FIG. 3G, FIG. 4A, FIG. 5A, 5B, 6A, 6B, 7A, 7B, 9A, 10A-10H, FIG. 11, 12, 13, 14, 15A-15D).

In some embodiments, the middle portion of the removable cover may, for example, further include a continuous opening on opposing ends, such that the detachable cover may be placed over an existing handle attached to a bag at both ends of the handle without removing the handle of the existing bag. (As depicted in FIGS. 2, 3C, 3D, 6A, 6B, 7A, 7B, 8A, 8B, 10A-10H, 11, 12,13, and 14,15A-15D).

In some embodiments, the channel portion of the at least one aperture handle extends to a peripheral edge of the opposing covers (as depicted in at least FIG. 3G in handle aperture 360*b* and handle aperture 360*d*). In some embodiments the at least one handle aperture is a first handle aperture, the channel portion is a first channel portion, and the peripheral edge is a first peripheral edge, further including a second handle aperture including a second channel portion extending to a second peripheral edge. (as depicted in at least FIG. 3G in handle aperture 360*b*).

In some embodiments, the opposing sides may, for example, include at least one secondary closing aperture on either side of each of the at least one handle aperture parallel to the longitudinal axis configured such that a closing member may be threaded through the secondary apertures to couple segments on either side of the handle apertures together such that the closing member runs across the channel portion of the at least channel preventing the handle of the existing bag from leaving the channel portion of the handle aperture when the existing bag is coupled to the detachable cover (as depicted in at least FIGS. 5A, 10A-10H, and FIG. 11). In some embodiments, the closing member includes a lacing member (as depicted in at least FIGS. 5A, 10A-10H, and FIG. 11). In some embodiments, the closing member includes a belt (as depicted in FIG. 13).

In some embodiments, the at least one handle aperture may, for example, be configured such that a first portion of the handle aperture is connected to a second portion of the handle aperture by a horizontal channel aperture (as depicted in: the handle aperture 360*a* in FIG. 3G, the handle aperture 360*c* in FIG. 3G, and in FIGS. 4A, 5B, 7A, 7B, and 9A).

In some embodiments, the removable bag cover may, for example, include an aperture closure module configured to selectively provide access into the existing bag through the detachable cover (as depicted in FIGS. 2, 3C, 3D, 6A, 6B, 7A, 7B, 8A, 8B, 10A-10H, 11, 12, 13, and 14). In some embodiments, the aperture closure module is a zipper configured to operate along the opening path segment (as depicted in at least FIGS. 2, 5A, 10A-10H, FIGS. 11, 12,13, and 14).

Figure 10E:
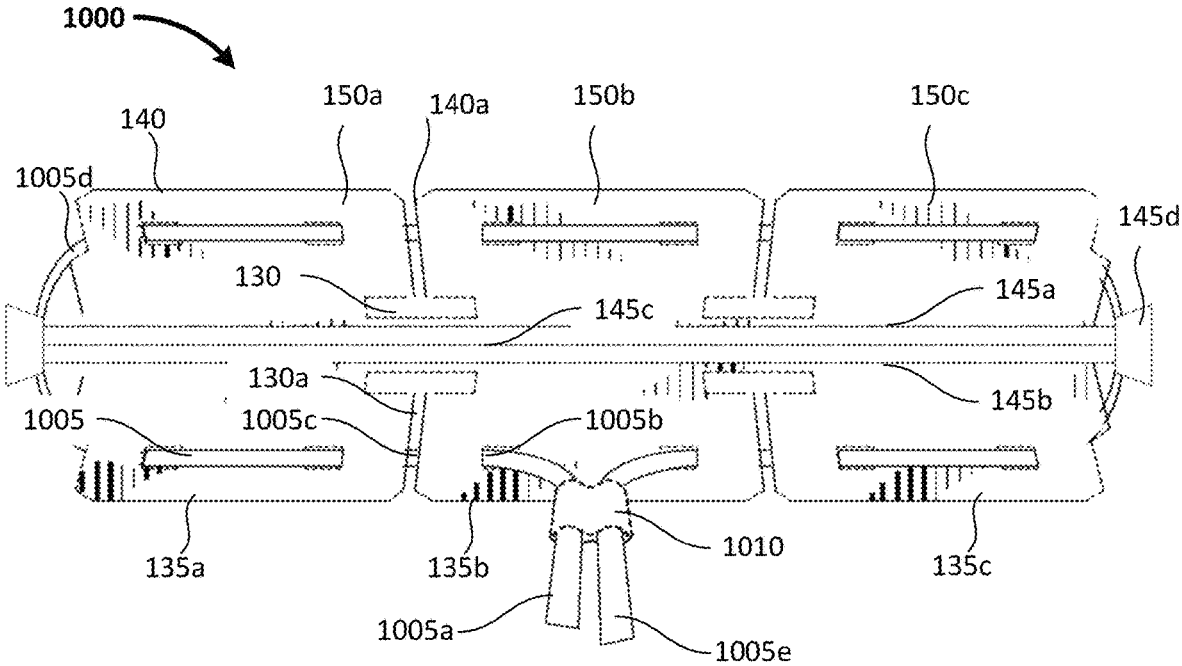
FIG. 10E depicts a bottom view of an exemplary RTC flattened.
Figure 10F:
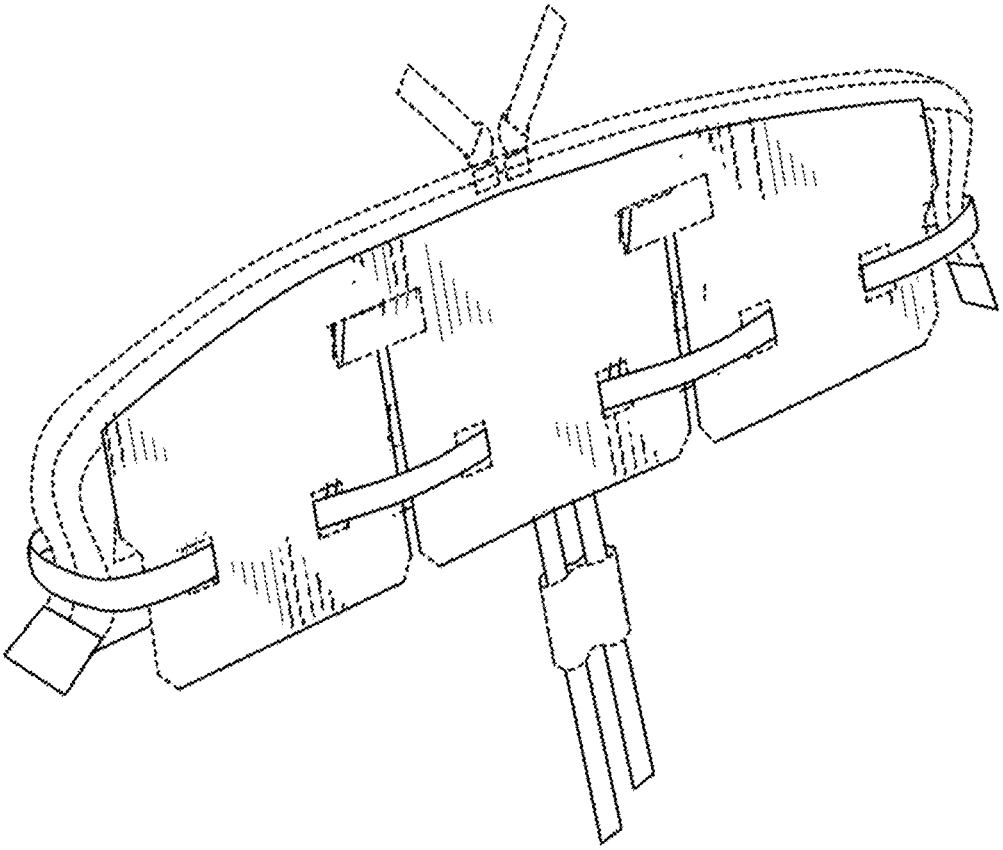
FIG. 10F depicts a perspective view of an exemplary RTC.
Figure 10G:
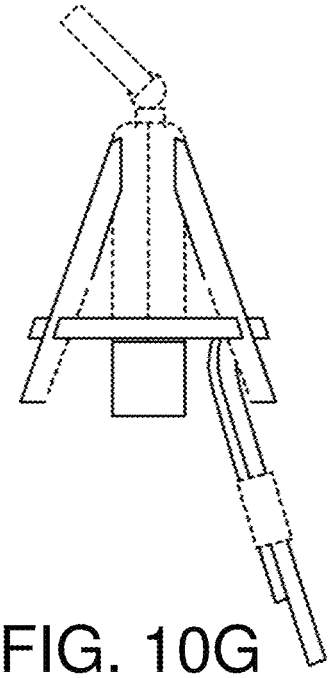
FIG. 10G depicts a side view of an exemplary RTC.
Figure 10H:
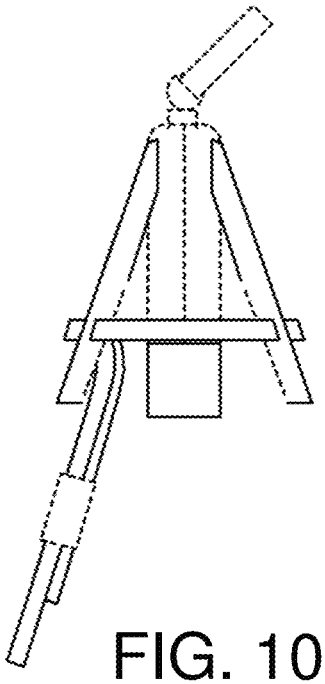
FIG. 10H depicts a side view of an exemplary RTC.
Figure 11:
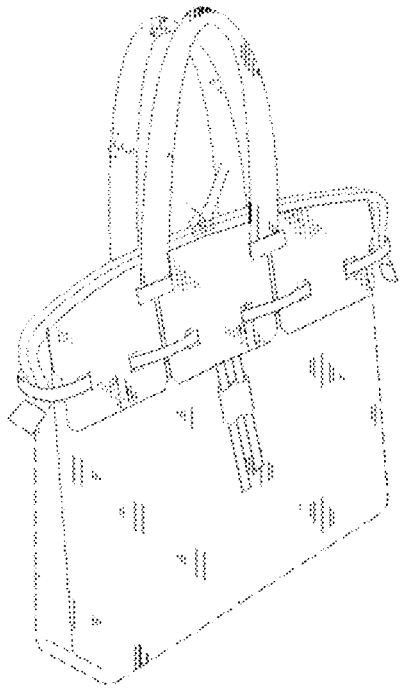
FIG. 11 depicts a perspective view of an exemplary RTC coupled to an exemplary bag as depicted in FIGS. 10A-10H.

In some embodiments, the removable bag cover may, for example, include a coupling module configured to releasably fasten the detachable cover to the existing bag (as depicted in the lacing member traverse crossing 1005*c* of the channel of the handle aperture in at least FIGS. 10A & 10E). In some embodiments, the coupling module is configured to connect opposing edges of the corresponding end such that the detachable cover is coupled to the bag (as depicted at least in 1005*d*, where the lacing tab 145*d* allows lacing 1005*d* to be threaded through or around the lacing tab to secure the opposing sides of the cover together in FIGS. 10A & 10E).

In some embodiments, the detachable cover further comprises a front side and a back side, wherein the detachable cover is reversible in operational use (as depicted in at least FIG. 3F).

In some embodiments, the detachable cover further includes at least one internal pocket (as depicted in FIG. 3D).

In some embodiments the detachable cover further includes at least one external accessory (as depicted in FIG. 3C).

Although various embodiments have been described with reference to the figures, other embodiments are possible.

Although an exemplary RTC has been described with reference to FIGS. 1-15D, other implementations may be deployed in other industrial, scientific, medical, commercial, and/or residential applications. The exemplary RTC may, for example, be used in the medical industry for medical personnel carrying medical equipment. The exemplary RTC may, for example, be used to carry a first aid kit alongside a tote bag. The exemplary RTC may, for example, allow a doctor to quickly open the bag by removing the cover and/or opening it with the zipper function. The exemplary RTC may, for example, be sold in kits including a variety of tote bags and exemplary RTC. The exemplary RTC may, for example, be sold in kits to include different variations to accommodate different types of bags (backpacks, purses, tote bags, etc.)

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A removable bag cover comprising a detachable cover extending along a longitudinal axis and configured to cover an opening into an existing tote bag including handles, comprising:

a first side cover portion;

a second side cover portion;

a middle portion between the first cover portion and the second side cover portion, the middle portion: (a) configured to facilitate folding such that the first side cover portion and the second side cover portion overlay each other to form opposing sides, and (b) comprising a continuous opening on opposing ends, such that the detachable cover may be placed over at least one existing handle attached to the tote bag at both ends of the handle without removing the handle of the existing tote bag;

at least one handle aperture through each of the opposing sides, the at least one handle aperture configured such that at least one handle of the existing tote bag is received through a channel portion of the at least one handle aperture extending to an opening situated on a peripheral edge of the opposing covers while both ends of the handle remain coupled to the bag; and, an aperture closure module configured to selectively provide access into the existing bag through the detachable cover along an opening path segment;

wherein, the opposing sides further comprise at least one lacing aperture on either side of each of the at least one handle aperture and parallel to the longitudinal axis, the at least one lacing aperture configured such that a closing member may be threaded through the at least one lacing apertures to couple together segments on either side of the handle apertures such that the closing member is configured to traverse the channel portion of the at least one handle aperture retaining the at least one handle of the existing tote bag within the at least one handle aperture when the detachable cover is coupled to the existing tote bag.

2. The removable bag cover of claim 1, wherein the aperture closure module is a zipper configured to operate along the opening path segment.

3. The removable bag cover of claim 1, further comprising a coupling module configured to releasably fasten the detachable cover to the existing bag.

4. The removable bag cover of claim 1, further comprising a lacing member threaded through the opposing covers to securely couple the detachable cover to the existing bag.

5. The removable bag cover of claim 1, wherein the channel portion of the at least one handle aperture extends to a peripheral edge of the opposing covers.

6. The removable bag cover of claim 1, wherein the at least one handle aperture of claim 5 is a first handle aperture, the channel portion of claim 5 is a first channel portion, and the peripheral edge is a first peripheral edge, further comprising a second handle aperture including a second channel portion extending to a second peripheral edge.

7. The removable bag cover of claim 1, wherein the closing member comprises a lacing member.

8. The removable bag cover of claim 1, wherein the closing member comprises a belt.

9. The removable bag cover of claim 1, wherein the at least one handle aperture is configured such that a first portion of the handle aperture is connected to a second portion of the handle aperture by a horizontal channel aperture.

10. The removable bag cover of claim 1, further comprising a coupling module configured to releasably fasten the detachable cover to the existing bag.

11. The removable bag cover of claim 1, wherein the detachable cover further comprises a front side and a back side, wherein the detachable cover is reversible in operational use.

12. The removable bag cover of claim 1, wherein the detachable cover further comprises at least one internal pocket.

13. The removable bag cover of claim 1, wherein the detachable cover further comprises at least one external accessory.

* * * * *